US005503132A

United States Patent [19]

Miyata et al.

[11] Patent Number: 5,503,132

[45] Date of Patent: Apr. 2, 1996

[54] DEVICE FOR DETECTING MISFIRE OF INTERNAL COMBUSTION ENGINE EQUIPPED WITH DOUBLE-ENDED DISTRIBUTORLESS IGNITION SYSTEM

[75] Inventors: Shigeru Miyata; Noriaki Kondo; Hiroshi Inagaki; Masaru Kondou, all of Nagoya, Japan

[73] Assignee: NGK Spark Plug Co., Ltd., Nagoya, Japan

[21] Appl. No.: 364,998

[22] Filed: Dec. 28, 1994

[30] Foreign Application Priority Data

| | | | |
|---|---|---|---|
| Dec. 28, 1993 | [JP] | Japan | 5-333898 |
| Mar. 8, 1994 | [JP] | Japan | 6-036207 |
| Aug. 24, 1994 | [JP] | Japan | 6-198848 |
| Oct. 7, 1994 | [JP] | Japan | 6-243944 |

[51] Int. Cl.[6] ..... F02P 17/00

[52] U.S. Cl. ..... 123/630; 123/656; 324/388; 324/399

[58] Field of Search ..... 123/479, 481, 123/630, 643, 647, 655, 656; 73/116, 117.2, 117.3; 324/378, 380, 388, 399

[56] References Cited

U.S. PATENT DOCUMENTS

| | | | |
|---|---|---|---|
| 5,144,936 | 9/1992 | Murata et al. | 123/630 X |
| 5,283,527 | 2/1994 | DeBiasi | 123/643 X |
| 5,400,760 | 3/1995 | Miyata et al. | 123/630 |

FOREIGN PATENT DOCUMENTS 4-179864 6/1992 Japan .

*Primary Examiner*—Tony M. Argenbright
*Attorney, Agent, or Firm*—Foley & Lardner

[57] ABSTRACT

A misfire detecting device for a double-ended distributorless ignition system is provided. The device includes a pulse generating circuit for generating a positive polarity pulse which is not so high as to cause spark discharge during the time after completion of spark discharge and before beginning of application of an ignition high voltage for next spark discharge. A reverse current preventing diode is connected at an anode to an output end of the pulse generating circuit and at a cathode to a positive polarity side of a secondary winding of an ignition coil. A plug voltage dividing circuit for dividing a plug voltage is connected between a center electrode and an outer or ground electrode of each of spark plugs to obtain a divided voltage. A detecting circuit detects a misfire of the spark plugs on the basis of an attenuation characteristic of the divided voltage after application of the positive polarity pulse.

14 Claims, 23 Drawing Sheets

DEVICE FOR DETECTING MISFIRE OF INTERNAL COMBUSTION ENGINE EQUIPPED WITH DOUBLE-ENDED DISTRIBUTORLESS IGNITION SYSTEM

BACKGROUND OF THE INVENTION

1. Field of the Invention

The present invention relates to a misfire detecting device for an internal combustion engine equipped with a double-ended DLI (distributorless ignition system).

2. Description of the Prior Art

An ignition system of the type having a distributor is shown in FIG. 21. The distributor type ignition system includes an ignition coil 901, a battery 903 and a power transistor 904 both connected to a primary winding 902 of the ignition coil 901, and an engine control unit (ECU) 905 for supplying an ignition signal to the power transistor 904, a distributor 907 for distribution of a high voltage induced in a secondary winding 906, and spark plugs 908~911 connected to side electrodes of the distributor 907.

As shown in FIG. 21, a misfire detecting device consisting of a voltage dividing circuit 912 for dividing a plug voltage between a center electrode and an outer electrode and a misfire detecting circuit 913 for detecting a misfire of a spark plug at each engine cylinder on the basis of an attenuation characteristic of the plug voltage is incorporated in the above described prior art ignition system. In the meantime, since a positive potential at the electrode of the spark plug makes it possible to attain a smaller electrical resistance between the center electrode and the outer electrode at normal combustion, i.e., at normal firing and therefore makes it possible to attain judgment of the attenuation characteristic of the plug voltage with ease, than the negative potential does, the connection of the ignition coil 910 is reversed to the usual.

On the other hand, a double-ended distributorless ignition system has recently been used in a great number. The ignition system, as shown in FIG. 22, consists of ignition coils 920 and 921 for simultaneous ignition or spark, power transistors 924 and 925 for intermittently supplying battery current to primary windings 922 and 923 of the ignition coils 920 and 921, an electronic control unit (ECU) 926 for delivering an ignition signal to the power transistors 924 and 925, and spark plugs 927~930. In the meantime, the distributorless ignition system does not utilize a distributor and thus can reduce the radio noise and the cost.

It was revealed that when the double-ended distributorless ignition system was provided with a similar misfire detecting device consisting of a voltage dividing circuit 912, diodes 931, and a misfire detecting circuit 913, it was encountered by a following disadvantage.

The distributorless ignition system shown in FIG. 22 is so structured as to apply a high negative voltage to the center electrodes of the spark plugs 928 and 930. The spark plug whose center electrode is at negative potential, maintains a high electrical resistance between the center electrode and the outer electrode or ground electrode even after normal combustion or firing, so a remarkable or prominent attenuation of the plug voltage does not occur and therefore there occurs such a case in which the attenuation characteristic of the plug voltage in case of normal firing does not differ so largely from that in case of occurrence of a misfire.

Due to this, there is caused a difficulty in detecting a misfire at an engine cylinder having installed therein a spark plug the center electrode of which is at a negative potential.

In order to solve this problem, a following technique has been proposed as described in Japanese Patent Provisional Publication No. 4-179864.

As shown in FIG. 23, a secondary winding 941 is connected at opposite ends thereof by spark plugs 942 and 943, a positive polarity bias 947 of about 300 volts is always applied by way of a resistor 945 and a diode 946 to the positive polarity terminal 944 of the secondary winding 941, and a voltage at the output terminal 948 is detected for thereby determining or knowing combustion within a cylinder, i.e., occurrence of a misfire at a cylinder.

However, the technique described in the above patent publication is encountered by a following disadvantage.

Since the voltage of the positive polarity bias 947 is low because it is about 300 volts, there may occur such a case in which if there is a contact defect in a distribution line such as a high tension cable, a plug cap, etc., the bias voltage cannot go over the defective place though the high voltage for causing spark can go over it, thus making it difficult to ascertain the combustion within each cylinder, i.e., occurrence of a misfire of a spark plug at each cylinder.

Since the structure is such that the positive polarity bias 947 is always applied, it is required, when to detect the combustion, i.e., occurrence of a misfire at a particular period of a combustion cycle, to carry out a waveform treatment (i.e., integration or masking over a certain interval) of the voltage at the output terminal 948.

SUMMARY OF THE INVENTION

In accordance with the present invention, there is provided a novel and improved misfire detecting device for a double-ended distributorless ignition system having an ignition coil for simultaneous spark, primary current supplying means for supplying battery current to a primary winding of the ignition coil intermittently, a first spark plug connected at a center electrode side to a positive polarity side of a secondary winding of the ignition coil and grounded at an outer electrode side, and a second spark plug connected at a center electrode side to a negative polarity side of the secondary winding of the ignition coil and grounded at an outer electrode side.

The misfire detecting device comprises pulse generating means for generating a positive polarity pulse which is not causative of spark discharge, during the time after completion of spark discharge and before beginning of application of an ignition high voltage for next spark discharge, a reverse current preventing diode connected at an anode to an output end of the pulse generating means and at a cathode to the positive polarity side of the secondary winding of the ignition coil, plug voltage dividing means for dividing a plug voltage between a center electrode and an outer electrode of each of the spark plugs to obtain a divided voltage therebetween, and detecting means for detecting a misfire of the spark plugs on the basis of an attenuation characteristic of the divided voltage after application of said positive polarity pulse.

With the above misfire detecting device, when the primary current supplying means supplies battery current to the primary winding of the ignition coil for simultaneous spark intermittently, a high voltage is induced in the secondary winding. Simultaneous with a positive potential high voltage being applied to the center electrode side of the first spark plug, a negative potential high voltage is applied to the center electrode side of the second spark plug, thus causing the first and second spark plugs to fire simultaneously. The pulse generating means produces a positive polarity pulse which is not causative of spark discharge between the center electrode and the outer electrode, during the time after completion of spark discharge and before beginning of application of a high voltage for next spark discharge. The positive polarity pulse is applied to the positive polarity side of the secondary winding by way of the reverse current preventing diode and then applied directly or by way of the secondary winding to the center electrodes of the first and second spark plugs without being affected by the condition of the distribution line. By the application of the positive polarity pulse, the floating capacity provided by the center electrode-to-outer electrode portions of the spark plugs, the connection lines for connection between the secondary winding and the spark plugs, the ignition coil, etc., is charged. In this instance, when the cylinder provided with the first spark plug is at a firing cycle, the charge in the above floating capacity moves to the center electrode-to-outer electrode portion of the first spark plug, so that the plug voltage attenuates. Further, when the second spark plug is at a firing cycle, the charge in the above described floating capacity moves to the center electrode-to-outer electrode portion of the second spark plug, so that the plug voltage attenuates. The voltage dividing means divides a plug voltage across the center electrode-to-outer electrode portion of the second spark plug in such a manner that the divided voltage is included within an allowable input range of the misfire detecting means. After occurrence of normal combustion within a cylinder, i.e., after occurrence of normal firing, the electrical resistance of the center electrode-to-outer electrode portion is lowered, so the plug voltage attenuates in an early time or shortly. However, in case of occurrence of a misfire of the spark plug at one of the cylinders, the electrical resistance at the center electrode-to-outer electrode portion is maintained high, so the plug voltage attenuates slowly or gradually. By this principle, the misfire detecting device detects the combustion condition within the cylinder, i.e., a misfire of a spark plug at each engine cylinder on the basis of the attenuation characteristic of the divided voltage.

According to a further aspect of the present invention, the misfire detecting device further comprises a diode connected at a cathode to an anode side of the reverse current preventing diode and grounded at an anode for unloading a negative charge remaining in a floating capacity.

With the above misfire detecting device, at the time of a misfire or at engine high speed, just after completion of the spark discharge and by the electromagnetic energy remaining in the ignition coil, a high voltage is developed in the secondary winding. In case the engine cylinder provided with a spark plug connected to the negative terminal side of the secondary winding is at the firing cycle and a high voltage is developed for the above described reason, the threshold voltage at the positive polarity side connected with the spark plug at the exhaust cycle is low. Thus, at the time of completion of spark discharge and in case a diode for unloading a negative charge is not provided, a considerably high negative charge is stored in the floating capacity of the center electrode-to-outer electrode portion. By the negative charge, the voltage of the positive polarity pulse applied by way of the diode to the positive polarity side of the secondary winding is lowered (at the time of a misfire or at high engine speed), thus lowering the accuracy of detection of a misfire or combustion condition. However, by the provision of the diode which is connected at the cathode to the anode side of the above described reverse current preventing diode and grounded at the anode, it becomes possible to unload the negative charge remaining in the floating capacity immediately or in a moment, so the voltage of the positive polarity pulse which is applied by way of the diode (or by way of the diode and the secondary winding) to the spark plug is not lowered.

According to a further aspect of the present invention, the voltage dividing means comprises a condenser voltage dividing circuit constructed of a capacitor of a small capacity and a capacitor of a relatively large capacity which are connected in series.

With the above voltage dividing means, voltage division is performed so that the positive polarity high tension pulse to be detected is a fraction of the total voltage corresponding to the capacity ratio of the capacitor of the relatively small capacity and the capacitor of the relatively large capacity and is included within an allowable input range of the misfire detecting means.

According to a further aspect of the present invention, there is provided a misfire detecting device for a double-ended distributorless ignition system having an ignition coil for simultaneous spark, primary current supplying means for supplying battery current to a primary winding of the ignition coil intermittently, a first spark plug connected at a center electrode side to a positive polarity side of a secondary winding of the ignition coil and grounded at an outer electrode side, and a second spark plug connected at a center electrode side to a negative polarity side of the secondary winding of the ignition coil and grounded at an outer electrode side. The misfire detecting device comprises pulse generating means for generating a positive polarity pulse which is not causative of spark discharge, during the time after completion of spark discharge and before beginning of application of an ignition high voltage for next spark discharge, first and second reverse current preventing diodes connected in series to each other for allowing the positive polarity pulse to pass therethrough and be supplied to the positive polarity side of the secondary winding of the ignition coil, voltage dividing means for dividing a voltage at a junction between an anode of the first diode and a cathode of the second diode to obtain a divided voltage thereat, and detecting means for detecting a misfire of the spark plugs on the basis of an attenuation characteristic of the divided voltage.

With the above misfire detecting device, when the primary current supplying means supplies battery current to the primary winding of the ignition coil for simultaneous spark intermittently, a high voltage is induced in the secondary winding. Simultaneous with a positive potential high voltage being applied to the center electrode side of the first spark plug, a negative potential high voltage is applied to the center electrode side of the second spark plug, thus causing the first and second spark plugs to fire simultaneously. The pulse generating means produces a positive polarity pulse which is not causative of spark discharge between the center electrode and the outer electrode, during the time after completion of spark discharge and before beginning of application of a high voltage for next spark discharge. The positive polarity pulse is applied to the positive polarity side of the secondary winding by way of the first and second diodes and then applied directly or by way of the secondary winding to the center electrodes of the first and second spark plugs without being affected by the condition of the distribution line. By the application of the positive polarity pulse, the floating capacity provided by the center electrode-to-outer electrode portions of the spark plugs, the connection lines for connection between the secondary winding and the spark plugs, the ignition coil, the connection line for connection between the first and second diodes and the voltage dividing means, is charged. In this instance, when the cylinder provided with the first spark plug is at a firing cycle, the charge in the above floating capacity moves to the center electrode-to-outer electrode portion of the first spark plug, so that the plug voltages attenuates. Further, when the second spark plug is at a firing cycle, the charge in the above described floating capacity moves to the center electrode-to-outer electrode portion of the second spark plug, so that the plug voltage attenuates. After occurrence of normal combustion within a cylinder, i.e., after occurrence of normal firing, the electrical resistance of the center electrode-to-outer electrode portion is lowered, so the potential at the junction between the cathode of the first diode and the anode of the second diode attenuates in an early time or shortly. However, in case of occurrence of a misfire of a spark plug at one of the cylinders, the electrical resistance at the center electrode-to-outer electrode portion is maintained high, so the potential at the junction attenuates slowly or gradually. The voltage dividing means divides the voltage at the junction between the cathode of the first diode and the anode of the second diode in such a manner that the divided voltage is included in an allowable input range of the misfire detecting device. In the meantime, the high voltage developed at the positive polarity side of the ignition coil for firing of a spark plug, is almost utilized at the time of firing of the spark plug and is not input to the voltage dividing means by the reverse current preventing action of the second diode. The misfire detecting device detects the combustion condition within the cylinder, i.e., a misfire of the spark plug at each cylinder on the basis of the attenuation characteristic of the divided voltage.

According to a further aspect of the present invention, the voltage dividing means comprises a condenser voltage dividing circuit constructed of a capacitor of a small capacity electrically connected at one of opposite ends to the junction and a capacitor of a relatively large capacity connected at one of opposite ends to the other of the opposite ends of the capacitor of a small capacity and grounded at the other of the opposite ends thereof, wherein the capacitors are installed on a single insulation substrate.

With the above voltage dividing means, the condenser voltage dividing circuit can be arranged all together on a single insulation substrate, and the voltage at the junction is divided so as to be a fraction of the total voltage corresponding to the capacity ratio of the capacitor of the relatively small capacity and the capacitor of the relatively large capacity and be included within an allowable input range of the misfire detecting means. In the meantime, by the reverse current preventing operation of the second diode, the high voltage developed in the secondary winding of the ignition coil for firing of the spark plugs does not move to the junction, so the withstand voltage of the capacitor of a small capacity can be set to be the voltage of the positive polarity pulse or so.

According to a further aspect of the present invention, the second diode is disposed within an electrically insulated casing of the ignition coil.

According to a further aspect of the present invention, the misfire detecting device for a double-ended distributorless ignition system having a plurality of ignition coils for simultaneous spark, primary current supplying means for supplying battery current to primary windings of the ignition coils intermittently and in turn, and a plurality of spark plugs connected at center electrode sides to secondary windings of the ignition coils and grounded at outer electrode sides. The misfire detecting device comprises pulse generating means for generating a positive polarity pulse which is not causative of spark discharge, during the time after completion of spark discharge of one of the spark plugs and before beginning of spark discharge of another of the spark plugs which is to discharge next, first diodes of the same number as the ignition coils and each connected at an anode to an output end of the pulse generating means, second diodes of the same number as the ignition coils and each connected at an cathode to a positive polarity side of the secondary winding of each of the ignition coils and at an anode to a cathode of each of the first diodes, voltage dividing means for dividing voltages at junctions between the cathodes of the first diodes and the anodes of the second diodes to obtain divided voltages thereat, and detecting means for detecting a misfire of the spark plugs on the basis of attenuation characteristics of the divided voltages.

With the above misfire detecting device, when the primary current supplying means supplies battery current to the primary windings of a plurality of ignition coils for simultaneous spark intermittently and in turn, a high voltage is induced in the secondary windings in turn. A set of spark plugs connected to the same ignition coil is caused to fire by application of the high voltage. The pulse generating means produces a positive polarity pulse which is not causative of spark discharge between the center electrode and the outer electrode, during the time after completion of spark discharge of the set of spark plugs and before beginning of spark discharge of another set of spark plugs which are to discharge next. The positive polarity pulse is applied to the positive polarity side of the secondary winding by way of the first and second diodes and then applied directly or by way of the secondary winding to the center electrodes of the set of spark plugs having finished spark discharge, without being affected by the condition of the distribution line. The voltage dividing means divides the total voltage in such a manner that the divided voltage is included within an allowable input range of the misfire detecting means. In the meantime, the high voltage developed at the secondary side of the ignition coil for firing the spark plug, is not input the voltage dividing means by the reverse current preventing operation of the second diode but is almost used for firing the spark plugs. For example, after occurrence of normal combustion within a cylinder, i.e., after occurrence of normal firing, the electrical resistance of the center electrode-to-outer electrode portion is lowered, so the plug voltage attenuates in an early time or shortly. However, in case of occurrence of a misfire of the spark plug at one of the cylinders, the electrical resistance at the center electrode-to-outer electrode portion is maintained high, so the plug voltage attenuates slowly or gradually. By this principle, the misfire detecting device detects the combustion condition within the cylinder, i.e., a misfire of a spark plug at each cylinder on the basis of the attenuation characteristic of the divided voltage.

The above device is effective for solving the above noted problems inherent in the prior art device.

It is accordingly an object of the present invention to provide a novel and improved misfire detecting device for an internal combustion engine equipped with a double-ended distributorless ignition system which can detect a misfire of a spark plug at each cylinder with accuracy without being affected by the conditions of the distribution lines of the ignition system, etc.

DETAILED DESCRIPTION OF THE PREFERRED EMBODIMENTS

Figure 1:
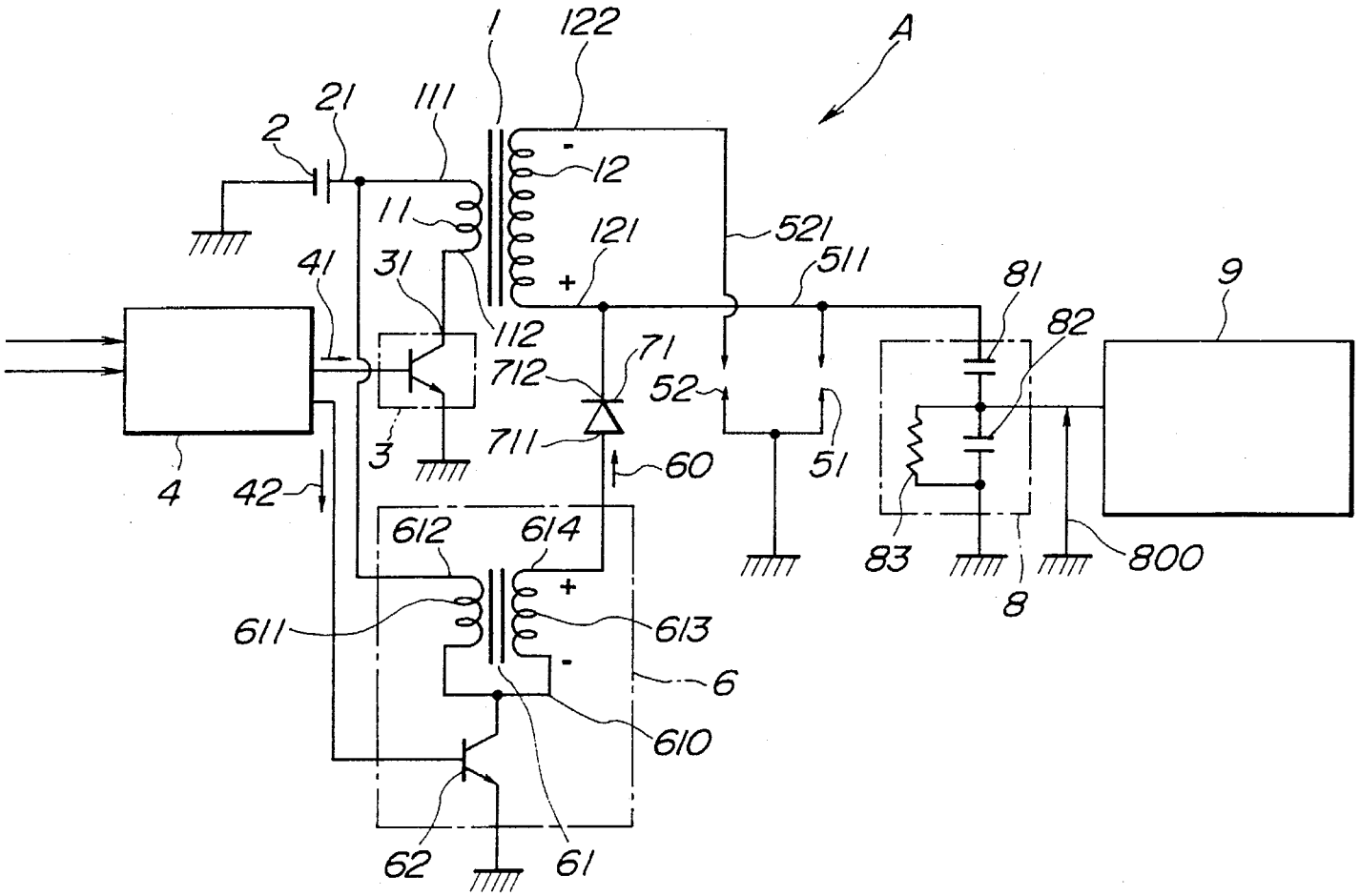
FIG. 1 is an electric circuit diagram of a double-ended distributorless ignition system in which a misfire detecting device according to an embodiment of the present invention is incorporated.
Figure 2:
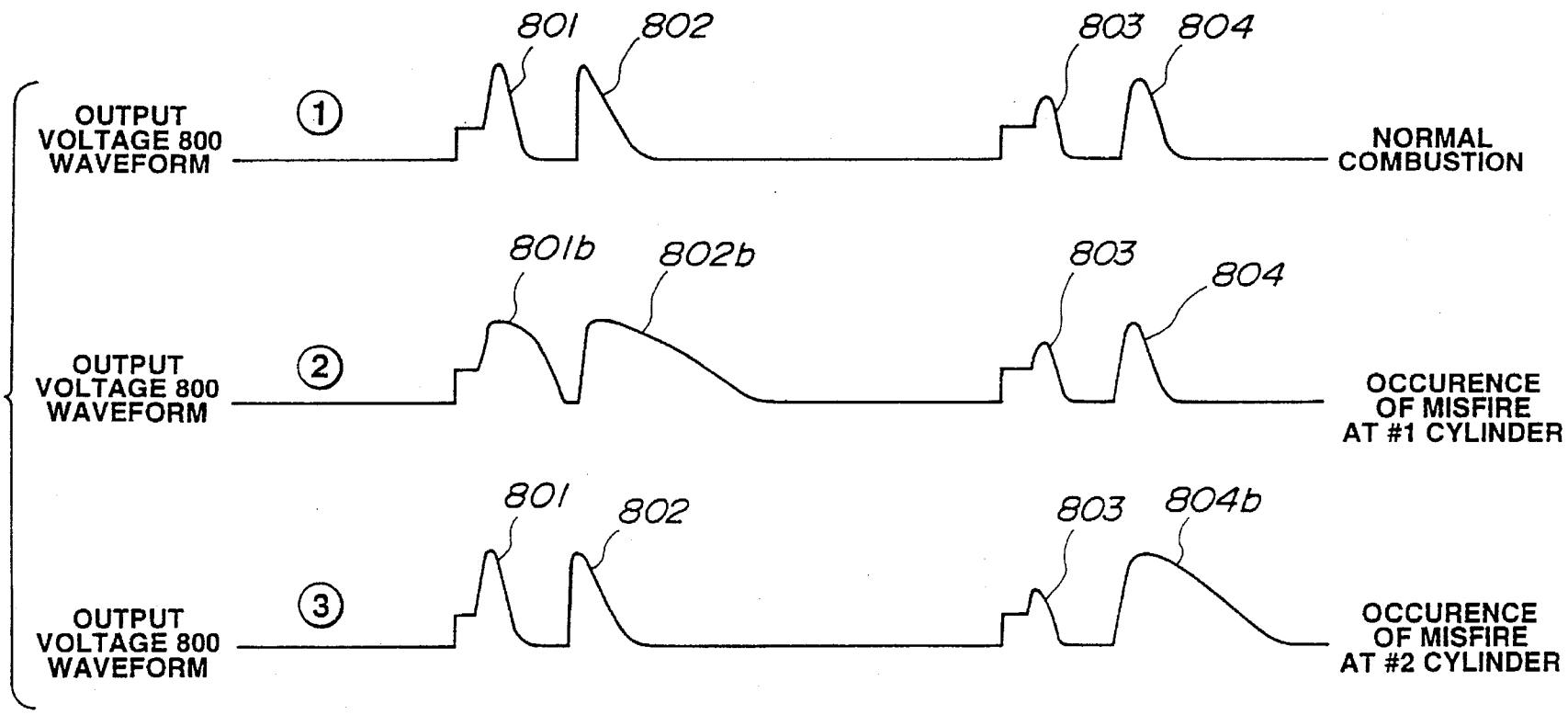
FIG. 2 is an illustration of output waveforms of the misfire detecting device of FIG. 1.

Referring first to FIGS. 1 and 2, a double-ended distributorless ignition system "A" having incorporated therein a misfire detecting device according to an embodiment of the present invention, includes an ignition coil 1, a battery 2 connected to a primary winding 11 of the ignition coil 1, a power transistor 3, an engine control unit (ECU) 4 for delivering an ignition signal 41 to the power transistor 3, a spark plug 51 connected at a center electrode thereof to a secondary high tension positive terminal 121 of a secondary winding 12, a spark plug 52 connected at a center electrode thereof to a secondary high tension negative terminal 122 of the secondary winding 12, a pulse generating circuit 6 for generating a positive polarity pulse 60, a diode 71 for supplying the positive polarity pulse 60 to the secondary high tension positive terminal 121 of the secondary winding 12, a plug voltage dividing circuit 8 for dividing a plug voltage across the center electrode-to-outer electrode portion of the spark plug 51, and a combustion condition or misfire detecting circuit 9 for detecting a combustion condition within a cylinder or misfire of a spark plug at each cylinder on the basis of an attenuation characteristic of an output voltage 800.

The ignition coil 1 is of the simultaneous ignition or spark type and composed of hundreds of turns of the primary winding 11 and tens of thousands of turns of the secondary winding 12 which are wound on an iron core. The iron core is formed from a plurality of thin silicon steel plates which are stacked on upon another. The windings are placed in a casing filled with resin. The ignition coil 1 has, on the top face of the casing, primary terminals 111 and 112, a secondary high tension positive terminal 121, and a secondary negative terminal 122 which are independent from each other.

The primary terminal 111 of the ignition coil 1 is connected to a positive terminal 21 of the battery 2, whilst the primary terminal 112 is connected to a collector 31 of the power transistor 3.

The secondary high tension positive terminal 121 and the secondary high tension negative terminal 122 of the ignition coil 1 are connected by way of high tension cables 511 and 521 to the center electrodes of the spark plugs 51 and 52, respectively.

The power transistor 3 for allowing battery current to flow intermittently to the primary winding 11 is put into an ON/OFF condition on the basis of an ignition signal 41 delivered from the engine control unit 4 and make the secondary winding 12 develop a high voltage of several tens kilovolts when operated to change from the ON condition to the OFF condition.

The engine control unit (ECU) 4 determines an optimum ignition timing on the basis of engine speed, coolant temperature, a signal from a cam position sensor, etc. and delivers an ignition signal 41 to the power transistor 3 so that spark discharge is caused at the optimum ignition timing. Further, the engine control unit 4 determines, on the basis of the determined optimum ignition timing, a timing for delivering a high tension pulse 60 and delivers a pulse generation instructing signal 42 to the pulse generating circuit 6.

In this embodiment, "primary current supplying means" is constituted by the engine control unit 4 and the power transistor 3.

The spark plugs 51 and 52 are installed on the #1 cylinder and #2 cylinder of a gasoline engine, respectively and adapted to fire or discharge when supplied with, during a compression stroke and an exhaust stroke, a positive high voltage in case of spark plug 51 or a negative high voltage in case of spark plug 52. Since the ignition system is of the double-ended type, the spark plug which is not on the firing cycle is caused to make waste spark or firing during an exhaust stroke. However, since such firing or spark is performed under a nearly atmospheric pressure condition, the required voltage and the arc maintaining voltage are both small so that the firing energy is always and mostly distributed to the spark plug on the firing cycle side.

The pulse generating circuit 6 in this embodiment is composed of a coil 61 connected at a primary contact 612 of a primary winding 611 to a positive terminal 21 of the battery 2, and a power transistor 62 connected at a collector to an internal connecting terminal 610. When the power transistor 62 in a turned on condition is biased off, a high voltage which is not causative of spark discharge or firing (about 3 kV in this embodiment) is produced at a secondary terminal 614 of a secondary winding 613.

A diode 71 which is connected at an anode 711 to the secondary terminal 614 (i.e., output end of the pulse generating circuit 6) and at an cathode 712 to the secondary high tension positive terminal 121, is a reverse flow preventing, high withstand voltage diode for applying a positive polarity high tension pulse 60 to the secondary positive terminals 121 whilst preventing current of the high voltage for firing of the spark plug 51 from flowing back to the pulse generating circuit 6.

The plug voltage dividing circuit 8 is constructed of a capacitor 81 of a relative small capacity (e.g., 5 pF) and a capacitor 82 of a relatively large capacity (e.g., 2500~5000 pF) which are connected in series to a high tension code 511 on the spark plug 51 side, and a resistor 83 of a high resistance (e.g., 10MΩ) connected in parallel to the capacitor 82.

In case of the capacities being 5 pF and 5000 pF, the voltage dividing ratio is 1/1000, the high voltage across the center electrode-to-outer electrode portion of a spark plug is divided and reduced to 1/1000 of the total voltage and the output voltage 800 is input to the misfire detecting circuit 9.

The misfire detecting circuit 9 detects a misfire of the spark plugs 51 and 52 installed in the respective #1 and #2 cylinders on the basis of the way of attenuation of the output voltage 800 (curves 802 and 804) developed by the application of the positive polarity pulse 60. In the meantime, in case of normal combustion or firing, the electrical resistance value between the center electrode and the outer electrode is lowered, so the output voltage 800 attenuates in an early time or shortly. However, in case of occurrence of a misfire, the electrical resistance value across the center electrode-to-outer electrode portion of a spark pug is maintained high, so the output voltage 800 attenuates gradually as depicted by the curves **801*b* and 802*b* of the waveform ② in FIG. 2 (occurrence of misfire at #1 cylinder) or by the curve 804*b* of the waveform ③ in FIG. 2** (occurrence of misfire at #2 cylinder).

The above described misfire detecting device has the following advantage.

(a) The combustion condition or misfire of the spark plugs 51 and 52 provided to the #1 and #2 cylinders is detected not on the bias of the output voltage 800 (curves 801 and 803) accompanied by the spark discharge of the spark plugs 51 and 52 but on the basis of the output voltage 800 developed by the application of the positive polarity pulse 60 (curves 802 and 804).

That is, the structure is such that the high tension positive polarity pulse 60 is applied to the center electrode side and the combustion condition or occurrence of a misfire of the spark plug at each cylinder is detected on the basis of the attenuation characteristic of the high tension pulse. Thus, even if there is a slight contact defect in a distribution line such as a high tension cable, plug cap or the like, a misfire of the spark plug at each cylinder or the combustion condition within each cylinder can be detected with accuracy.

Further, since the polarity of the pulse 60 applied to the center electrode side is positive, detection of the combustion condition of the #2 cylinder, i.e., a misfire at the #2 cylinder provided with the spark plug 52 which is connected at the center electrode side to the secondary high tension negative terminal 122 of the ignition coil 1 can also be attained with accuracy.

Further, in the above detection, a difficult processing of the waveform of the output voltage 800 is not necessary.

Figure 3:
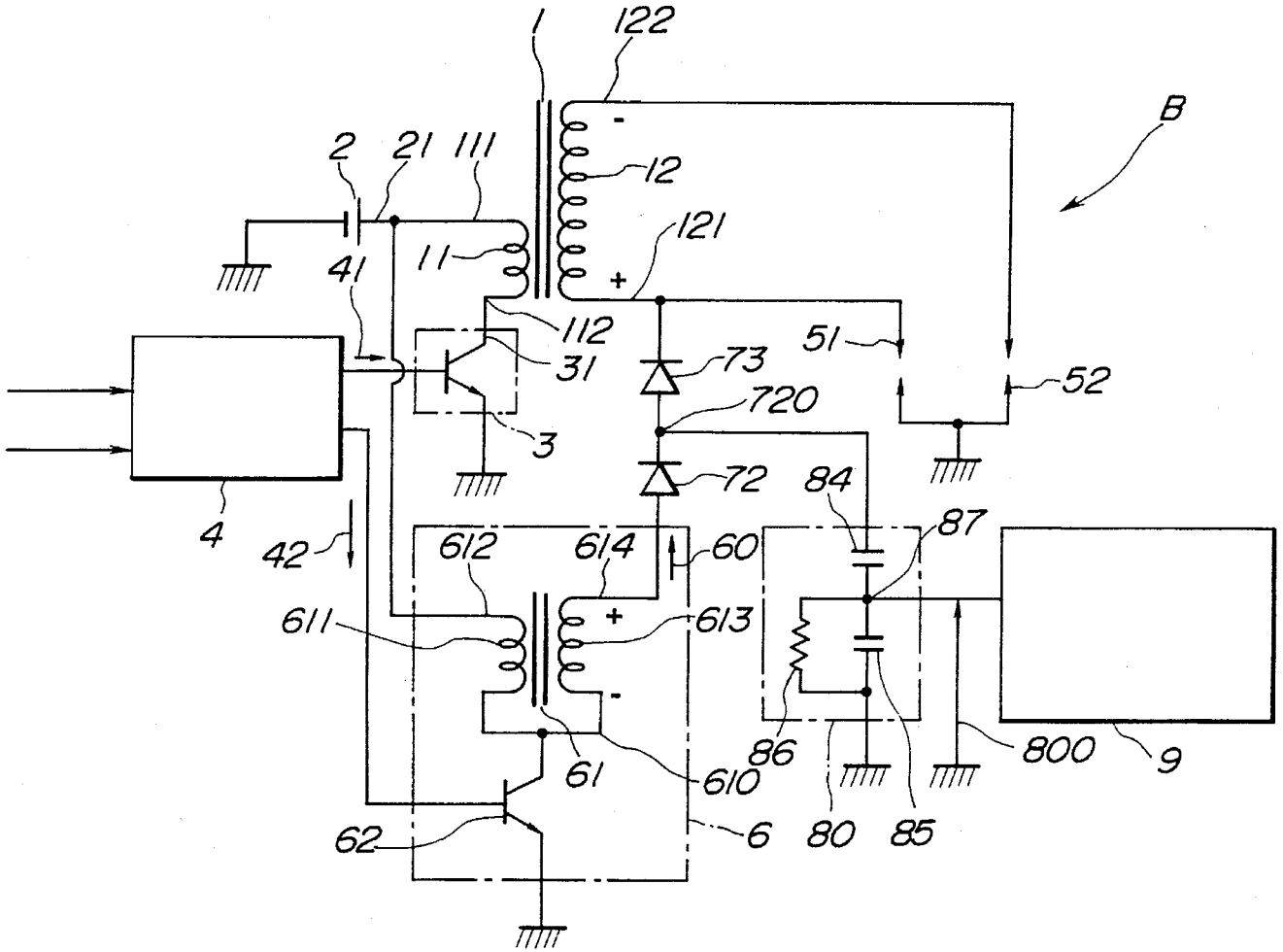
FIG. 3 is an electrical circuit diagram of a double-ended distributorless ignition system in which a misfire detecting device according to a second embodiment of the present invention is incorporated.
Figure 4:
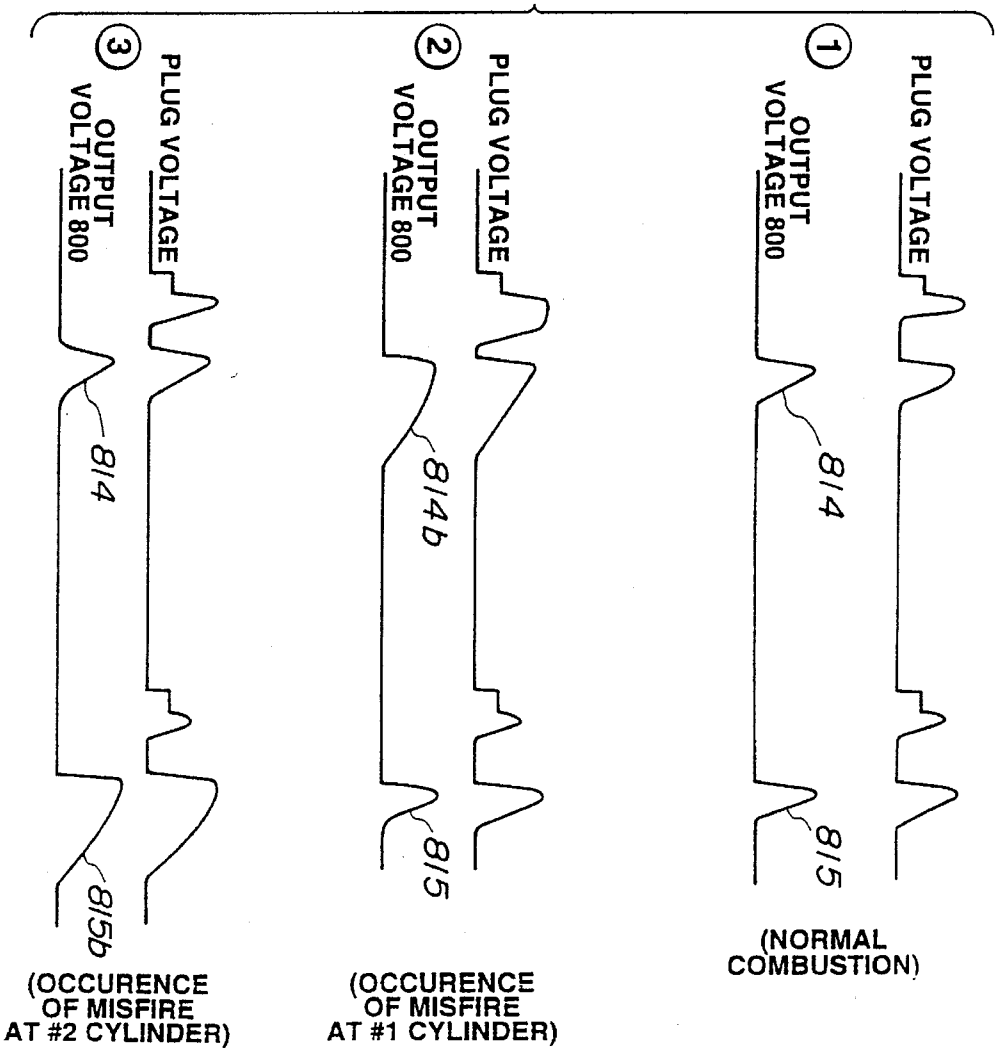
FIG. 4 is an illustration of plug voltages and output waveforms of the misfire detecting device of FIG. 3.

Referring to FIGS. 3 and 4, a second embodiment of the present invention will be described.

As shown in the drawings, a misfire detecting device of this embodiemnt incorporated in a double-ended distributorless ignition system "B" differs from the first embodiment of FIG. 1 in that the secondary terminal 614 of the coil 61 and the secondary high tension positive terminal 121 of the ignition coil 1 are connected by way of diodes (reverse current preventing, high withstand voltage diodes) 72 and 73 and it is adapted so that the potential at the junction 720 between the diodes 72 and 73 is supplied to a condenser voltage dividing circuit 80.

The condenser voltage dividing circuit 80 is constructed of a capacitor 84 of a relatively small capacity and a capacitor 85 of a relatively large capacitor which are connected in series and supplies the output voltage 800 developed at a junction 87 to the misfire detecting circuit 9. The capacitor 84 is connected at one end to a junction 720 and at the other end to one end of the capacitor 85 which is connected in parallel to a resistor 86, and the other end of the capacitor 85 is grounded. Further, in this embodiment, since a maximum potential at the junction 720 is 3 kV or so, the voltage dividing ratio is set to about 1/300.

The misfire detecting circuit 9 detects the combustion condition or a misfire at the #1 and #2 cylinders on the basis of the way of attenuation of the output voltage 800 (curves 814 and 815) developed by the application of the positive polarity pulse 60 (about 3 kV). In FIG. 4, various output voltage waveforms 814, **814*b* and 815** in connection with plug voltages at the time of normal combustion or firing, occurrence of a misfire at the #1 cylinder and occurrence of a misfire at the #2 cylinder are shown.

This embodiment has the following advantage.

(b) The high voltage built up at the secondary high tension positive terminal 121 of the ignition coil 1 for causing the spark plug 51 (in other embodiments, spark plugs 54 and 56) to fire is not developed at the junction 720 (in other embodiments, junction 730) by the reverse flow preventing action by the diode 73 (in other embodiments, diode 75) and is not input to the condenser voltage dividing circuit 80. Due to this, the high voltage for firing does not have any influence on the misfire detecting circuit 9, thus making it possible to simplify the structure of the misfire detecting circuit 9. Further, the withstand voltage of the capacitor 84 of the small capacity can be relatively low because it can be around 3 kV, so the capacitor 84 which is cheap can be used and therefore it becomes possible to reduce the cost.

Figure 5:
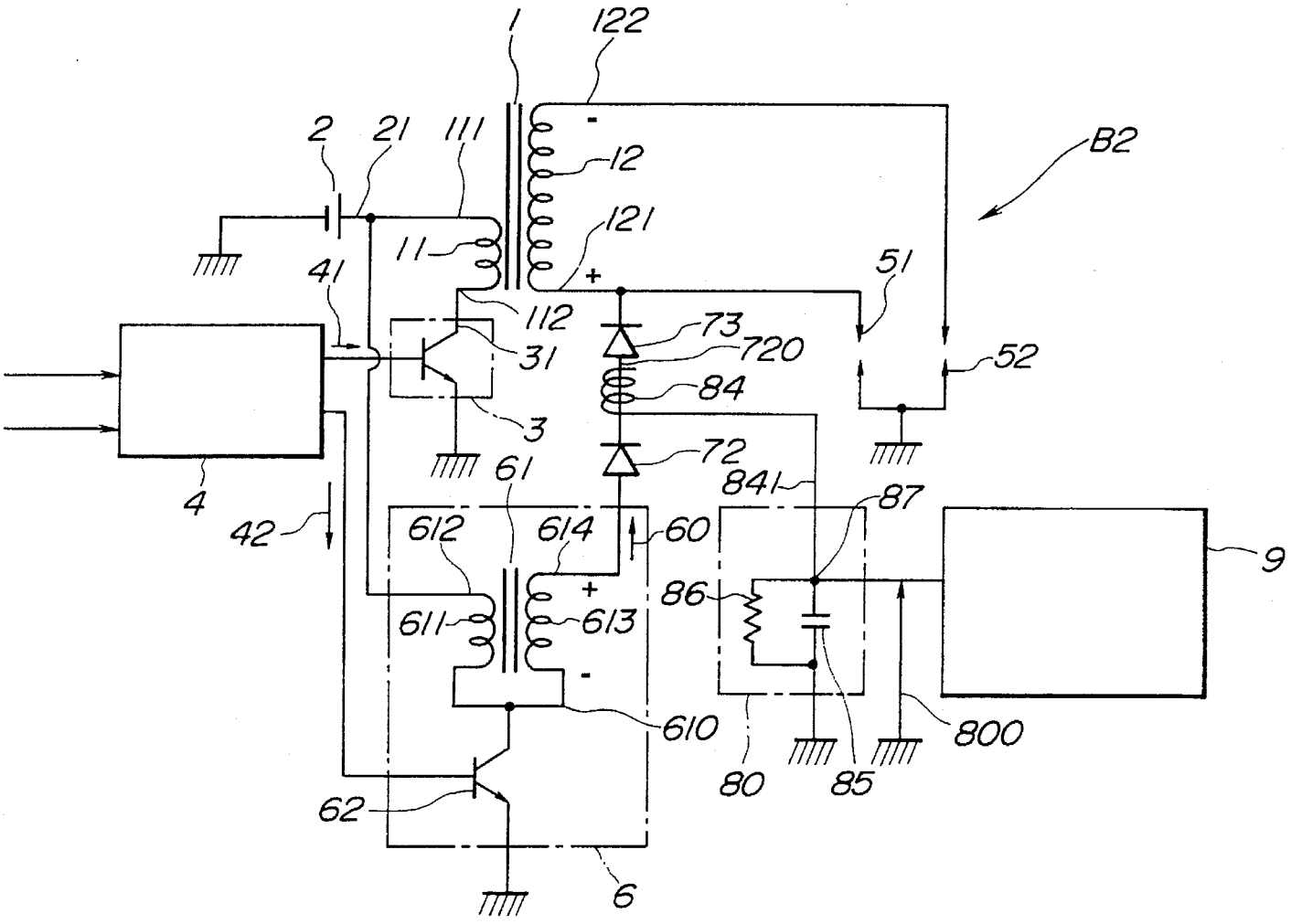
FIG. 5 is an electrical circuit diagram of a double-ended distributorless ignition system in which a misfire detecting device according to a third embodiment of the present invention is incorporated.

Referring to FIG. 5, the third embodiment of the present invention will be described.

A misfire detecting device of this embodiment incorporated in a double-ended distributorless ignition system "B2" differs from the second embodiment of FIGS. 3 and 4 in that the capacitor 84 is constructed so as to obtain a small capacity (about 3 pF) by winding a wire 841 around the lead wire concerned with the joint 720.

This embodiment has the following advantage.

(c) It becomes possible to reduce the cost of the capacitor 84 of the small capacity, thus making it possible to further reduce the manufacturing cost.

Figure 6:
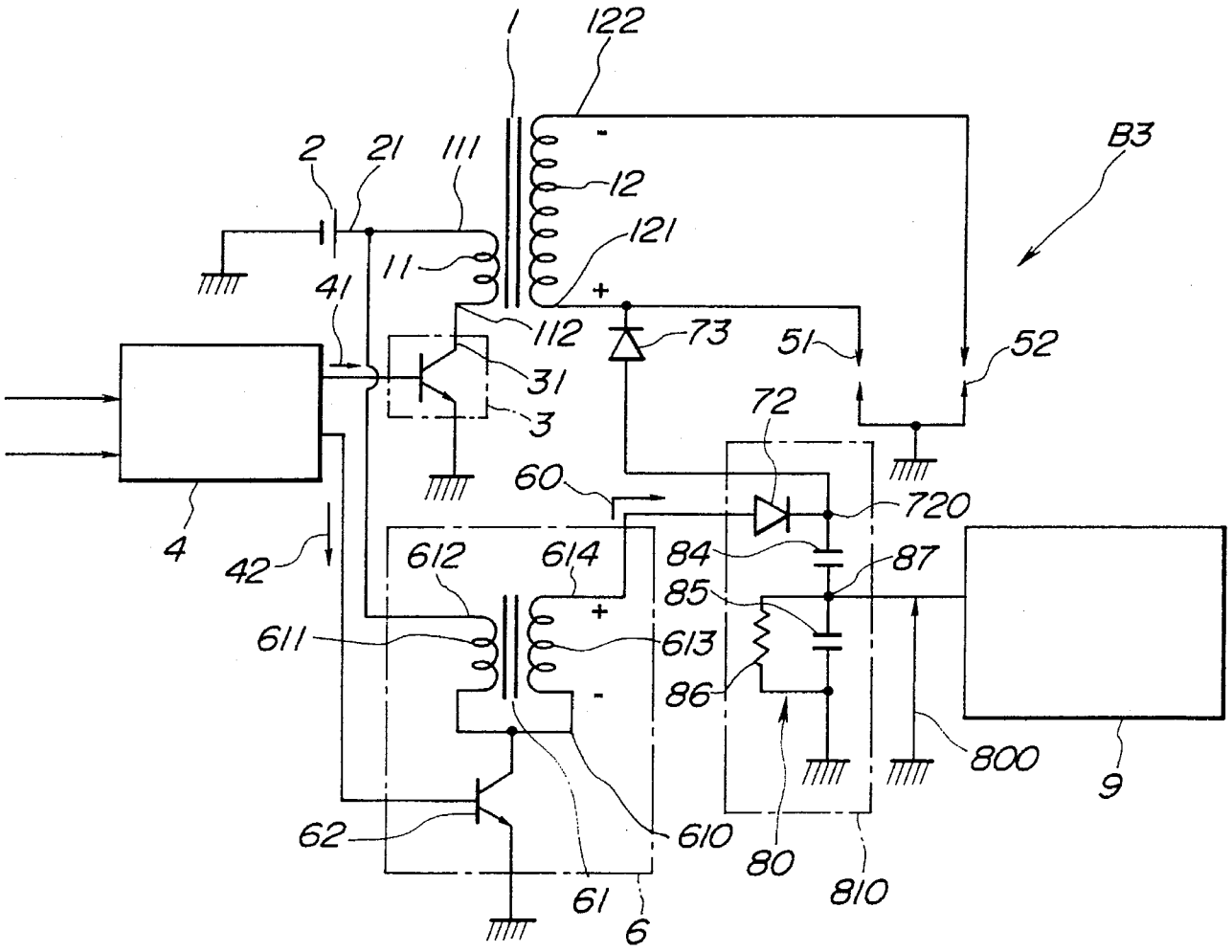
FIG. 6 is an electrical circuit diagram of a double-ended distributorless ignition system in which a misfire detecting device according to a fourth embodiment of the present invention is incorporated.
Figure 7:
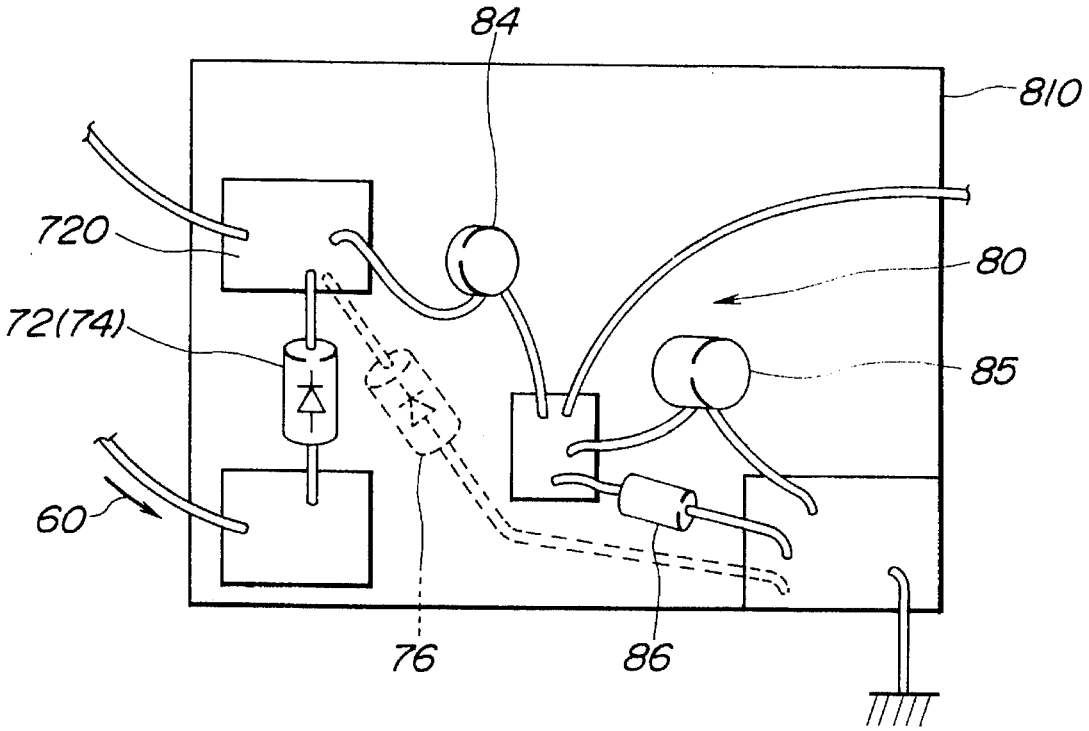
FIG. 7 is a top plan view of a substrate utilized in the misfire detecting device of FIG. 6.

Referring to FIGS. 6 and 7, the fourth embodiment of the present invention will be described.

As shown in FIGS. 6 and 7, a misfire detecting device of this embodiment incorporated in a double-ended distributorless ignition system "B3" differs from the second embodiment of FIG. 3 and the third embodiment of FIG. 5 in that the condenser 80 and the diode 72 are formed on a single substrate (e.g., made of glass epoxy) 810. In the meantime, the diode 73 is disposed on the ignition coil 1 side, so that the cathode lead wire is of the small length and connected to the secondary high tension positive terminal 121.

The condenser voltage dividing circuit 80 is constructed of a capacitor 84 of a relatively small capacity (about 3 pF) connected at one end to the junction 720, and a capacitor 85 of a relatively large capacity connected at one end to the other end of the capacitor 84, whereby to divide the voltage at the junction 720 in such a manner that the divided voltage is about 1/300 of the total voltage.

This embodiment has, in addition to the above advantage (b), the following advantage.

(d) Since the condenser voltage dividing circuit 80 and the diode 72 (in other embodiments, diodes 74 and 76) are installed all together on the single substrate 810, it becomes possible to reduce the space occupied by the double-ended distributorless ignition system "B3" and improve the ability of maintenance.

Figure 8:
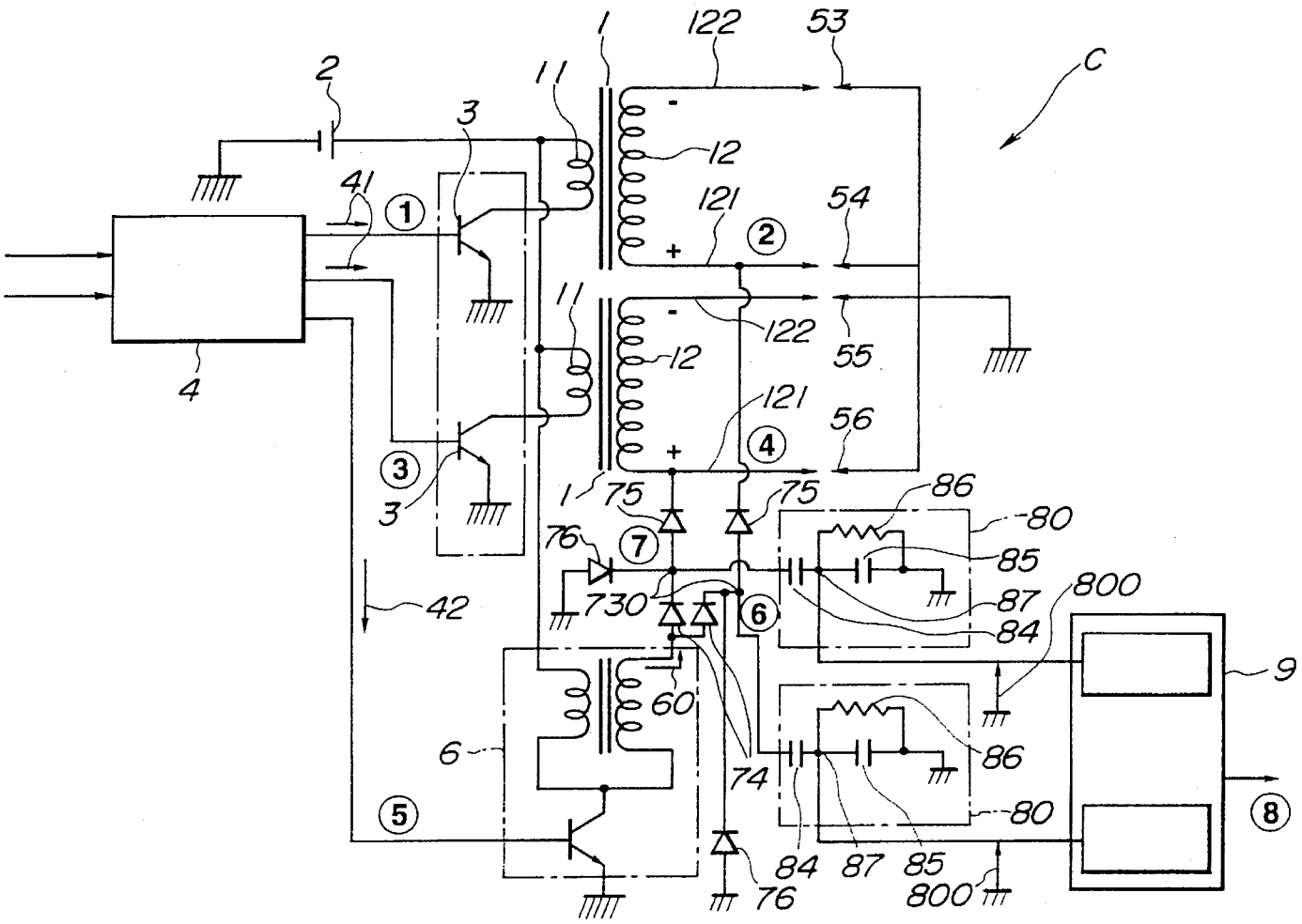
FIG. 8 is an electrical circuit diagram of a double-ended distributorless ignition system in which a misfire detecting device according to a fifth embodiment of the present invention is incorporated.
Figure 9:
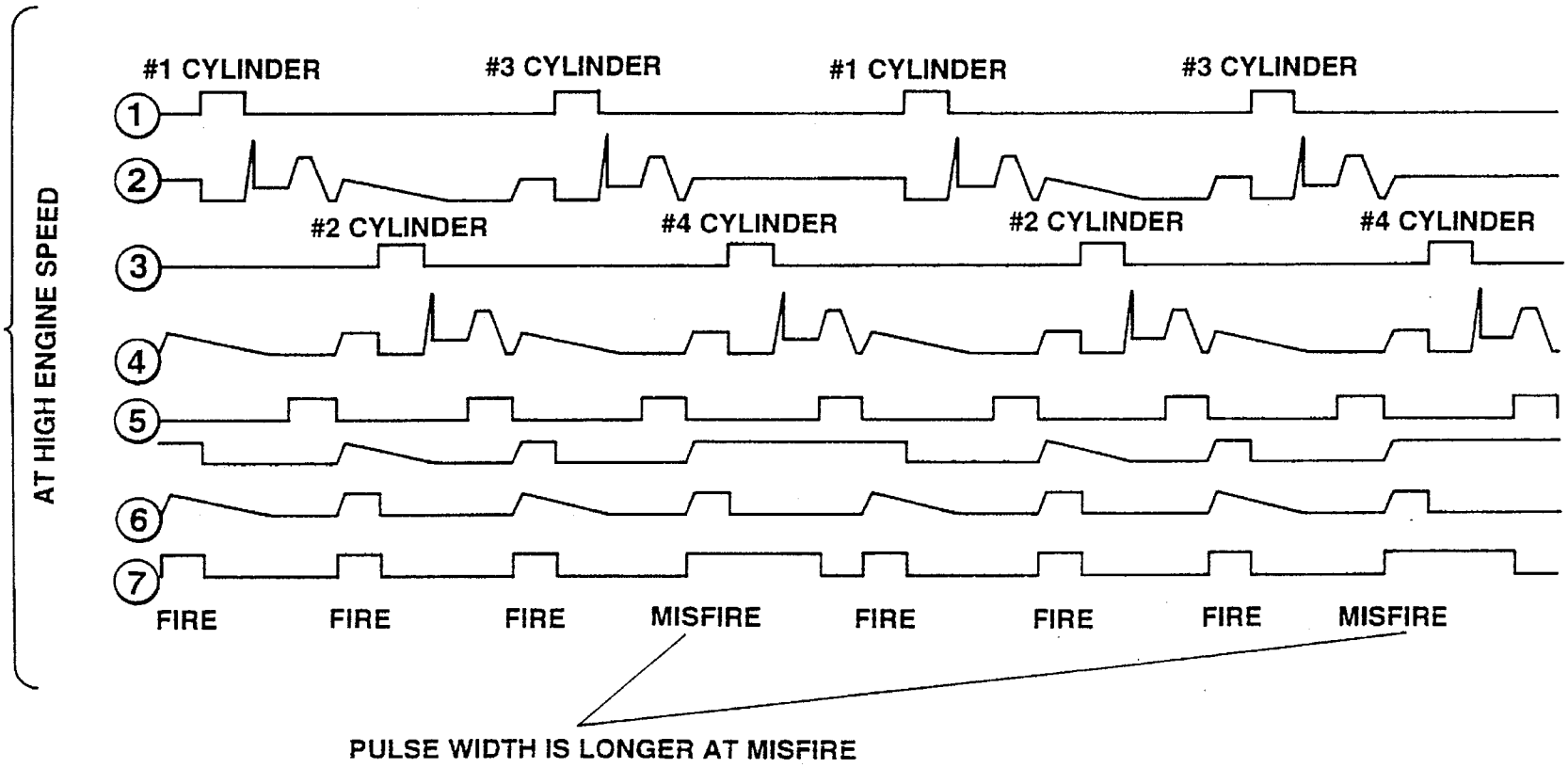
FIG. 9 is an illustration of various waveforms at various places in the ignition system of FIG. 8.

Referring to FIGS. 8 and 9, the fifth embodiment of the present invention will be described.

As shown in FIG. 8, a double-ended distributorless ignition system "C" (for a four-cylinder gasoline engine) having incorporated therein a misfire detecting device of this embodiment includes spark plugs 53 and 55 connected at center electrodes thereof to the secondary high tension negative terminals 122, spark plugs 54 and 56 connected at center electrodes thereof to the secondary high tension positive terminals 121, second diodes 74, first diodes 75, a pulse generating circuit 6 for generating a positive polarity pulse 60, condenser voltage dividing circuits 80 for dividing the voltages at the junctions 730, and a misfire detecting circuit 9 for receiving the output voltages 800.

The ignition coils 1 are connected at the secondary high tension positive terminals 121 to the center electrodes of the spark plugs 54 and 56. Further, the secondary high tension negative terminals 122 are connected to the center electrodes of the spark plugs 53 and 55, respectively.

The diodes 75 are reverse current preventing, high withstand voltage diodes for preventing current of a high voltage for spark discharge from flowing reversely toward the condenser voltage dividing circuits 80.

Figure 13:
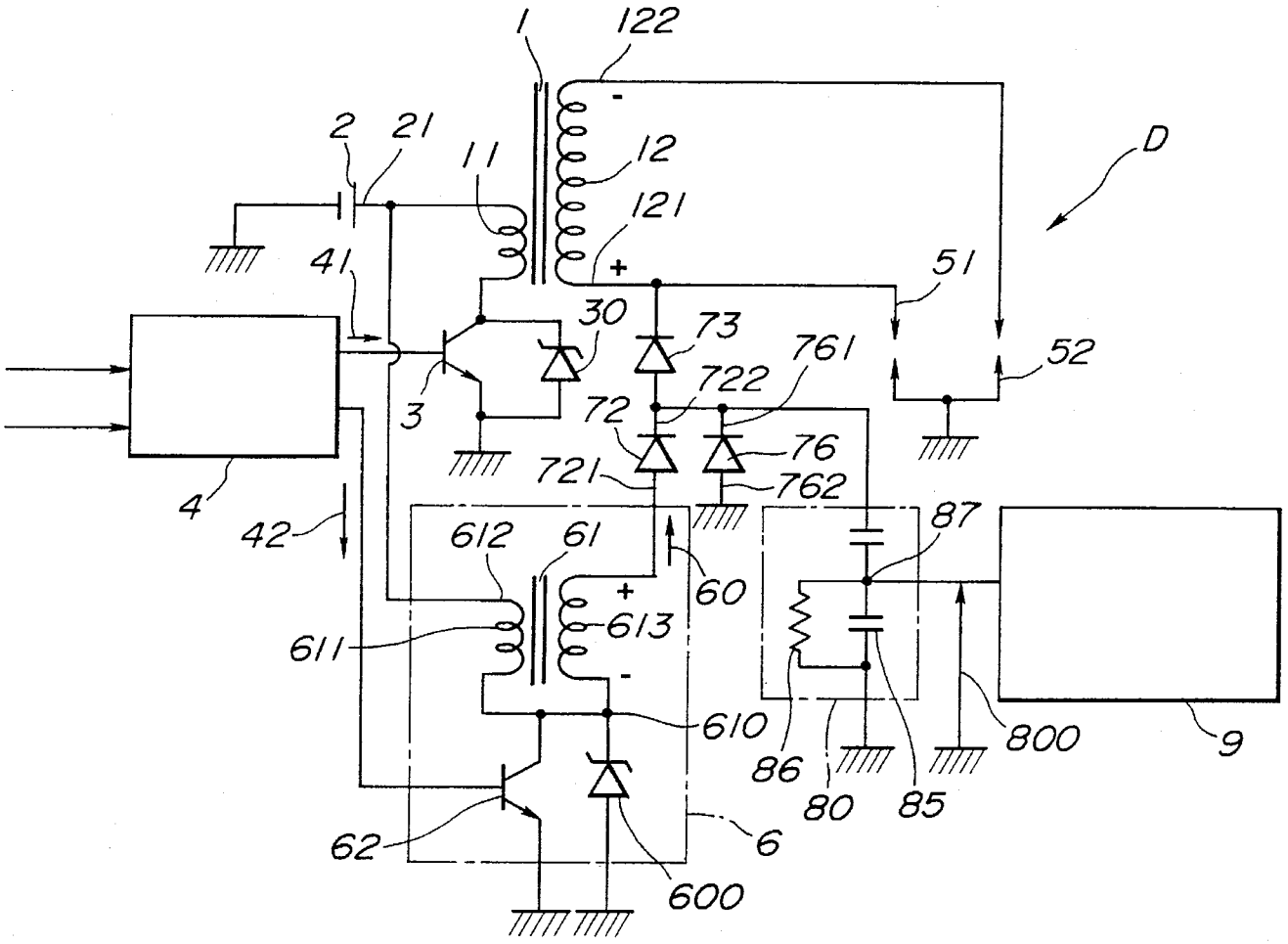
FIG. 13 is an electrical circuit diagram of a double-ended distributorless ignition system in which a misfire detecting device according to a seventh embodiment of the present invention is incorporated.

The diodes 76, which will be described in detail hereinlater with respect to the seventh embodiment of FIGS. 13 and 14, are provided for releasing or unloading the negative potential remaining in the high tension cable or the spark plugs 54~56 and thereby reducing it to nearly zero.

The condenser voltage dividing circuits 80 are the same as that used in the second embodiment of FIG. 3, and two circuits are used.

The reason why the respective numbers of the diodes 74 and the condenser voltage dividing circuits 80 used in this embodiment are the same as that of the ignition coils 1, i.e., two, will be described.

Figure 10:
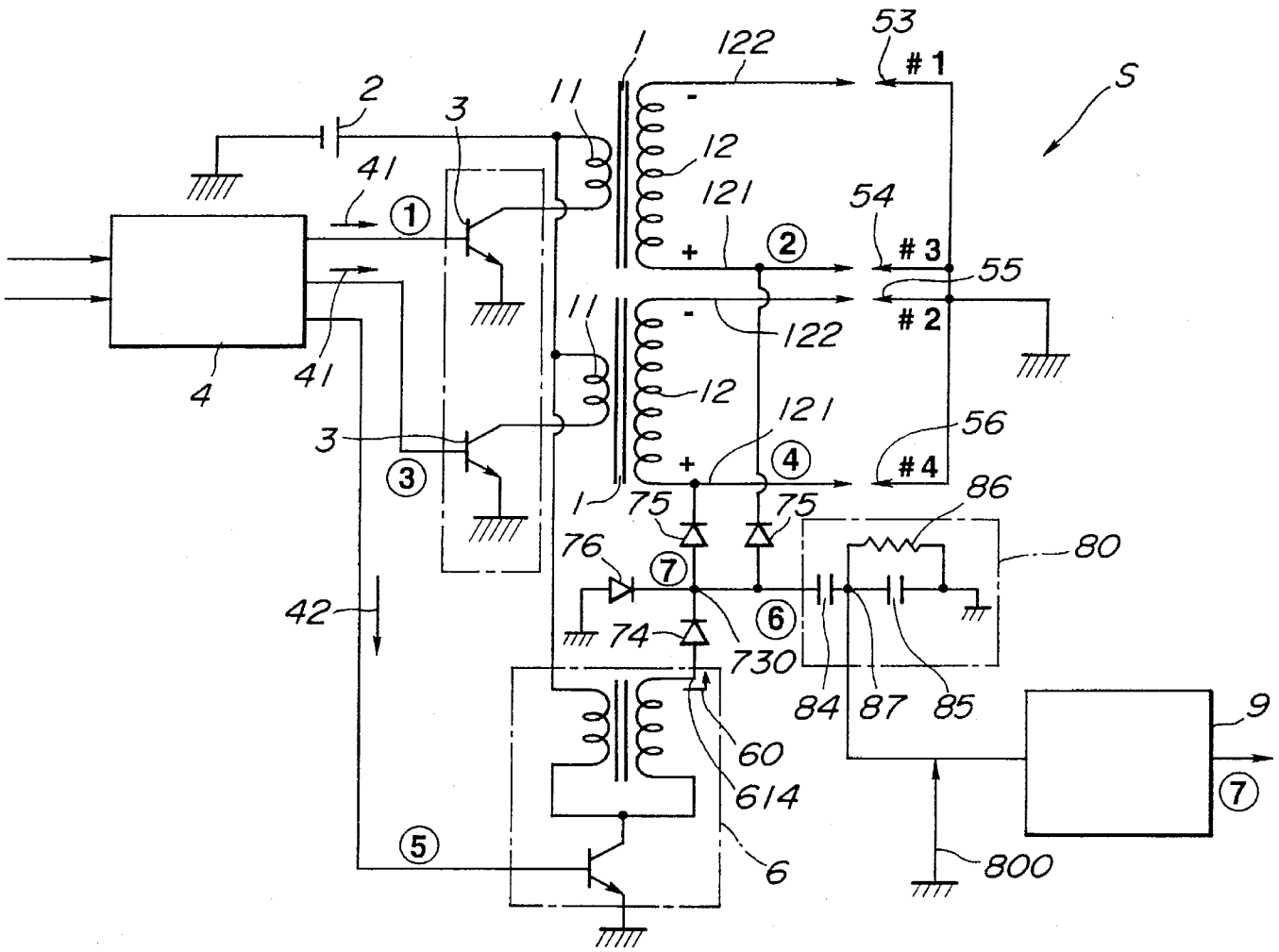
FIG. 10 is an electrical circuit diagram of a comparative ignition system.
Figures 11A, 11B:
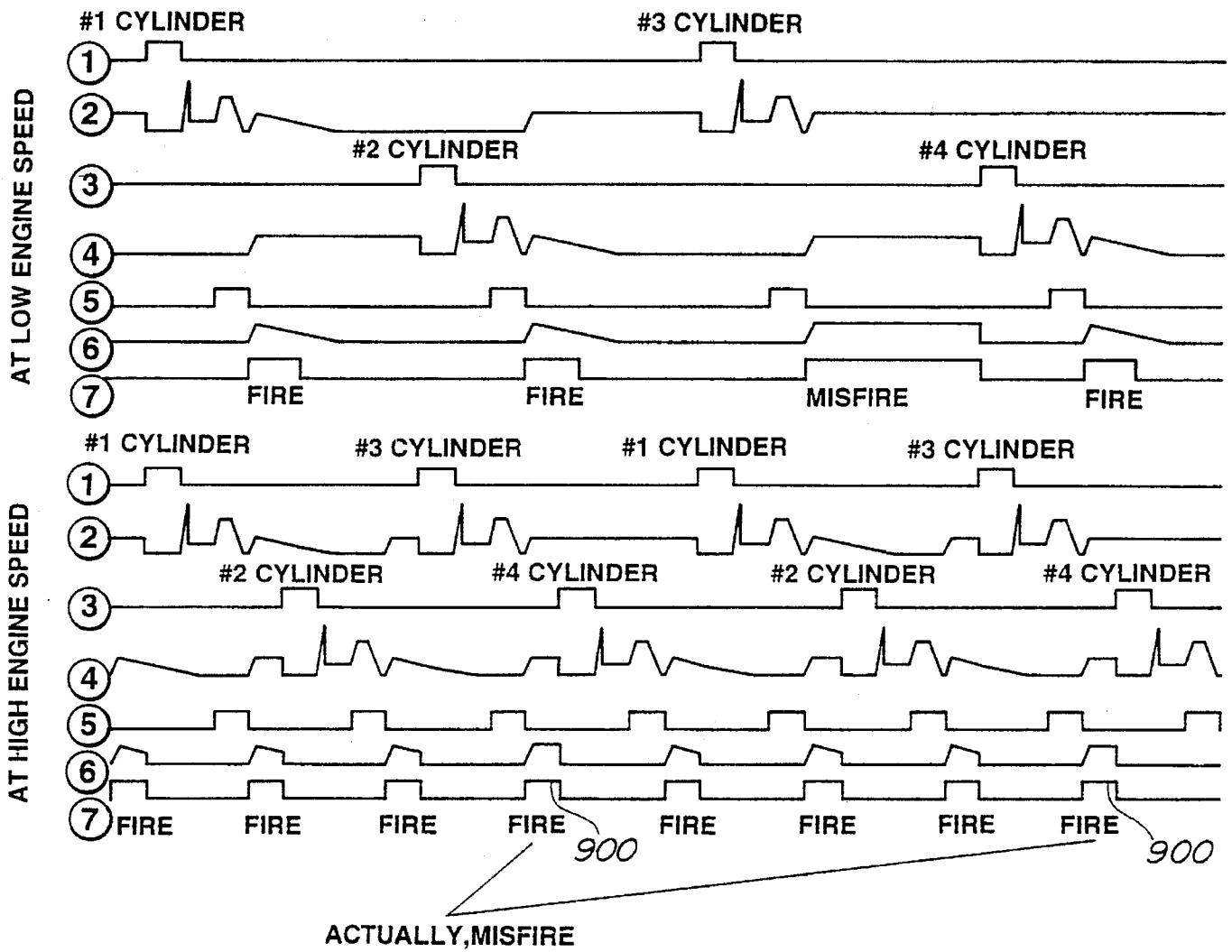
FIGS. 11A–B are illustrations of various waveforms at various places in the comparative ignition system of FIG. 10.

FIG. 10 shows a comparative example of a double-ended distributorless ignition system "S" having incorporated therein a misfire detecting device. In the ignition system "S", the voltage dividing circuit 8 and the misfire detecting circuit 9 are respectively provided by one. In FIGS. 11A–B, the waveforms at various places ①~⑦ in the ignition system "S" are shown.

With the ignition system "S", when the engine speed is low (refer to low engine speed of FIG. 11), the intervals between the firings of the spark plugs at each cylinders are wide. So, in case the pulse generating circuit 6 outputs a positive polarity pulse 60 under low engine speed, the ignition timing of the next cylinder comes after the charge has been unloaded completely by ion current, thus making it unnecessary to consider the effect of the behavior of the ignition coil 1 on the detection of a misfire.

However, when the engine speed becomes higher (refer to high engine speed of FIG. 11B), the ignition timing of the next cylinder comes before the charge is unloaded completely by ion current, so the effect of the behavior of the ignition coil 1 on the detection of a misfire results.

More specifically, when the positive polarity pulse 60 is output to the ignition coil 1 of upper one in FIG. 10 and the timing of energization of the ignition coil 1 of lower one comes before the charge is unloaded completely, a high voltage of a polarity reverse to that at the time of firing is caused in the secondary winding 12. That is, a negative voltage is developed at the secondary high tension positive terminal side of the ignition coil 1 which is lower one in the drawing, resulting in that the charge at the junction 730 is absorbed and the voltage at the junction 730 is reduced to zero in a moment.

In case of normal combustion or firing, the misfire detecting circuit 9 produces a pulse of a small width, so there is not caused any problem. However, although a pulse of a large width must properly be produced in case of occurrence of a misfire, the production of the pulse is suspended at the beginning of the time of energization, thus causing a problem that it becomes impossible to carry out detection of a misfire on the engine control unit side (refer to the condition 900 in FIG. 11B).

However, since the respective numbers of the diodes 74 and the condenser voltage dividing circuits 80 utilized in the double-ended distributorless ignition system "C" having incorporated therein a misfire detecting device of this embodiment are the same as that of ignition coils 1, i.e., two, such a disadvantage is not caused even at high engine speed but a pulse of a large width can be produced in case of occurrence of misfire as indicated by the waveform ⑧ in FIG. 9, thus making it possible to detect a misfire even at a high engine speed zone (advantage "e").

Further, the misfire detecting device incorporated in the double-ended distributorless ignition system "C" has an advantage similar to the above described advantage (a).

Figure 12:
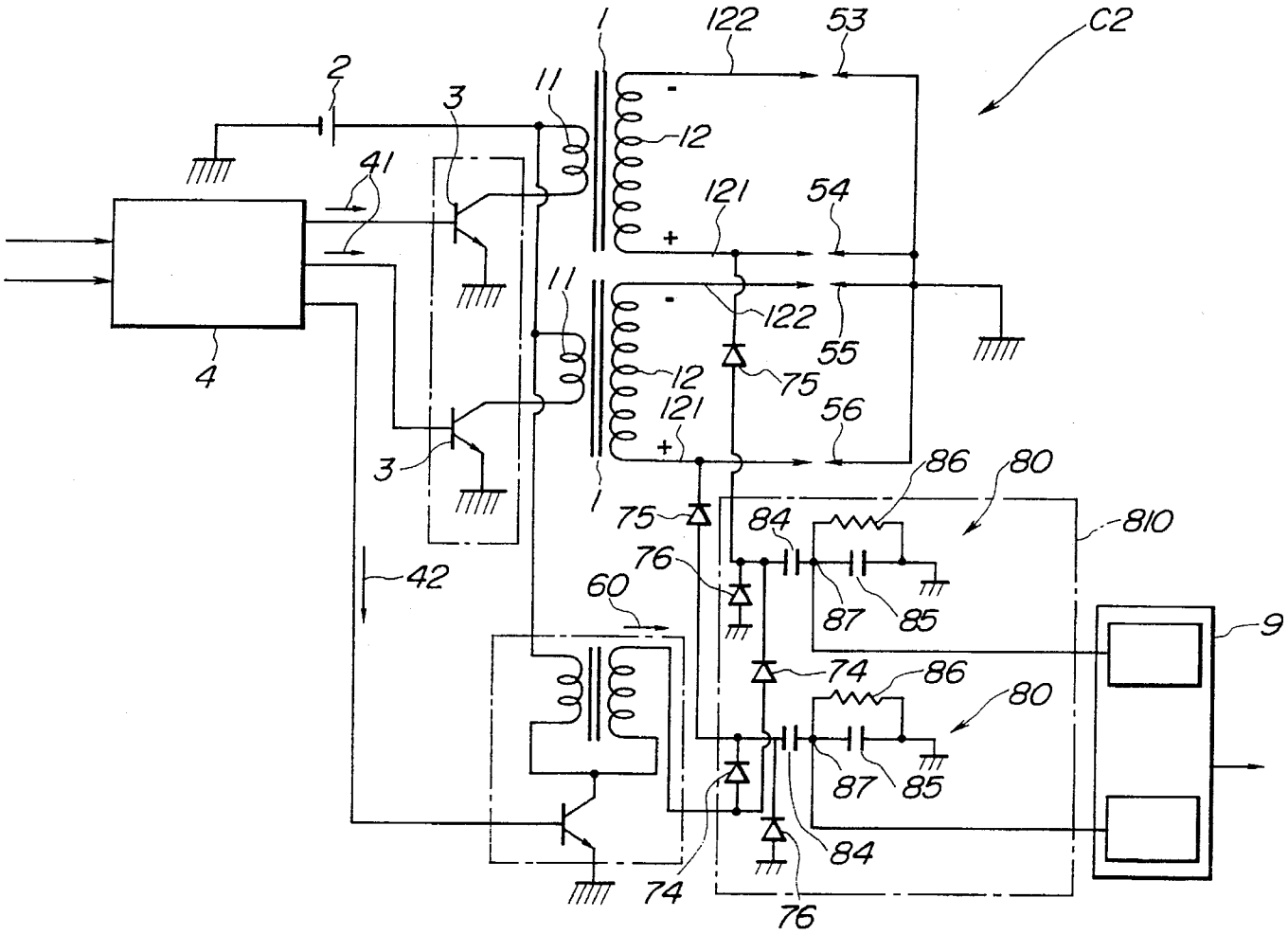
FIG. 12 is an electrical circuit diagram of a double-ended distributorless ignition system in which a misfire detecting device according to a sixth embodiment of the present invention is incorporated.

Referring to FIG. 12, the sixth embodiment of the present invention will be described.

As shown in FIG. 12, a misfire detecting device of this embodiment incorporated in a double-ended distributorless ignition system "C2" is differs from the fifth embodiment of FIGS. 8 and 9 in that the condenser voltage dividing circuits 80 and the diodes 74 are installed all together on the single substrate 810 and has the above described advantages (b), (d) and (e).

Figure 14A:
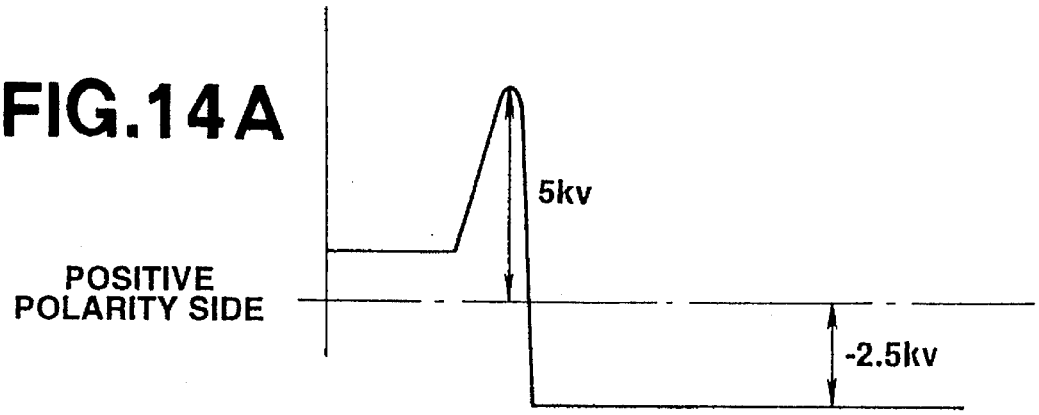
FIGS. 14A–B are illustrations of waveforms of the plug voltage at a positive polarity and a negative polarity on a secondary side of an ignition coil of the ignition system of FIG. 13.
Figure 14B:
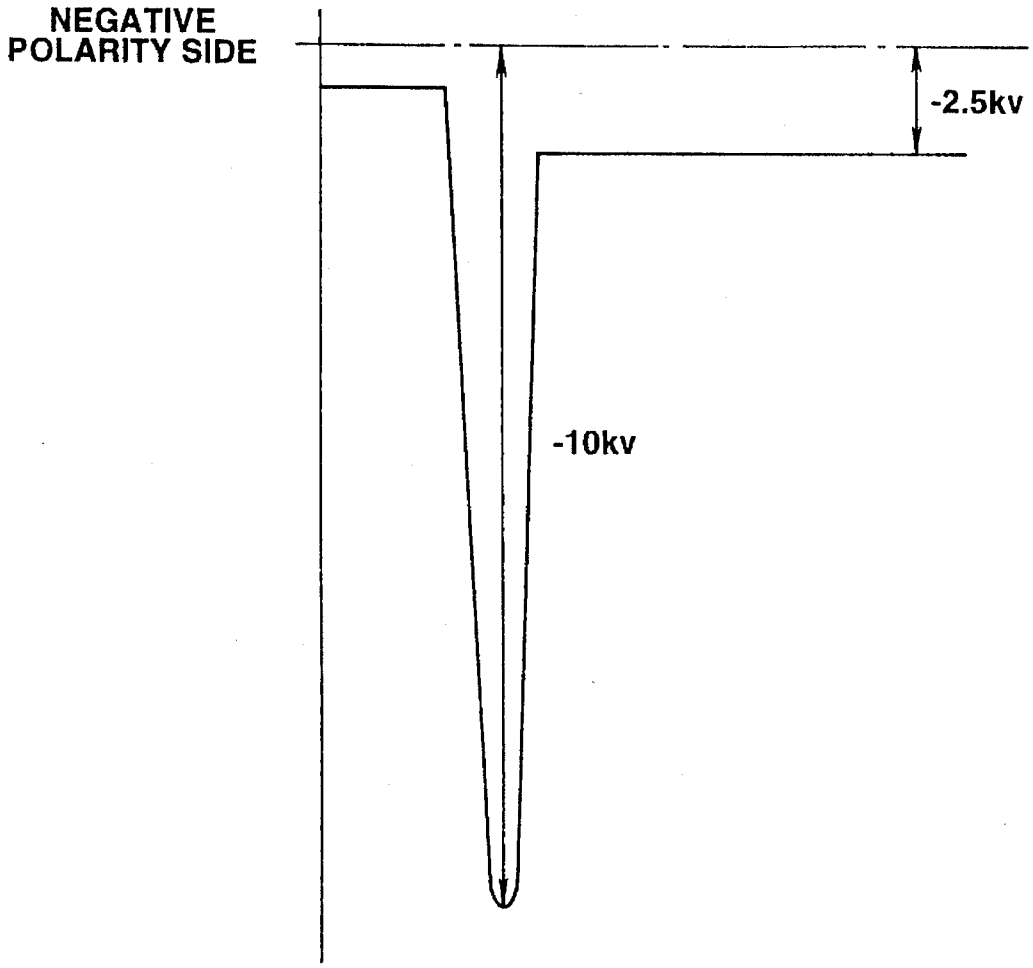

Referring to FIGS. 13 and 14A–B, the seventh embodiment will be described.

The seventh embodiment can solve, for example, the following disadvantages of the second embodiment of FIG. 3 (also can solve the disadvantage of the first embodiment of FIG. 1).

At high engine speed or at the time of misfire, a high voltage is developed in the secondary winding 12, just after completion of spark discharge for firing, by the energy remaining in the ignition coil 1.

In case such a high voltage as described above is developed, during a firing cycle, at the negative side (i.e., the secondary high tension negative terminal 122 side) of the double-ended distributorless ignition system, the positive polarity threshold voltage during an exhaust cycle is low, thus allowing the voltage charged in the spark plugs 51 and 52, etc. after completion of spark discharge to become so high.

For example, as shown in FIGS. 14A–B, when the peak voltage on the negative side just after completion of spark discharge is −10 kV and the peak voltage on the positive side is +5 kV, the average voltage is about −2.5 kV.

When the voltage of the positive polarity pulse 60 for detection of a misfire is +2 kV, the applied voltage is varied by the output impedance of the pulse generating circuit 6 and the floating capacity of the spark plug and is, for example, reduced to about +0.5 kV. As a result, the accuracy of measurement is lowered.

If, in such a case, the voltage of the positive polarity pulse 60 is set to be +4 kV with a view to retaining the applied voltage of, for example, +2 kV, spark discharge may be caused when the offsetting voltage is not so high to the contrary or the firing cycle is to be performed by the voltage of the positive polarity, resulting in a possibility that detection of the combustion condition or a misfire cannot be attained successfully.

As shown in FIG. 13, the double-ended distributorless ignition system "D" having incorporated therein a misfire detecting device (for use in a gasoline engine), includes an ignition coil 1, a battery 2 connected to the primary winding of the ignition coil 1, a power transistor 3, an engine control unit (ECU) 4 for delivering an ignition signal to the power transistor 3, spark plugs 51 and 52 connected to the secondary winding of the ignition coil 1, a pulse generating circuit 6, diodes 72, 73 and 76, a condenser voltage dividing circuit 80, and a misfire detecting circuit 9.

The ignition coil 1 is of the double-ended DLI (distributorless ignition system) type and connected at the secondary high tension positive terminal 121 to the center electrode of the spark plug 52. Indicated by 30 is a Zener diode for restricting a high voltage for ignition or firing.

Indicated by 600 is a Zener diode disposed between an internal connection terminal 610 and ground (between collector and emitter between power transistor 62) and of a Zener voltage of 20 V and restricts the voltage of the primary winding to about 20 V. By the effect of the turn ratio of the coil 61 (i.e., the ratio of the number of turns of the primary winding 611 to that of the secondary winding 613) which is set to 1:100, the peak voltage at the positive polarity pulse 60 is maintained at +2 kV regardless of a variation of the battery voltage.

The diode 73 is a high withstand voltage diode for preventing reverse current of a high voltage for spark discharge toward the voltage dividing circuit 8.

The diode 76 is connected at a cathode 761 to a cathode 722 of a diode 72 which is connected at an anode 721 to the output terminal of the pulse generating circuit 6, and releases or unloads the negative charge remaining in the high tension code, spark plugs 51 and 52, etc. so that the remaining charge is reduced to nearly zero.

The condenser voltage dividing circuit 80 and the combustion condition or misfire detecting circuit 9 are the same as those of the second embodiment of FIG. 3.

This embodiment has the following advantages.

(f) Since the negative charge remaining in the floating capacities of the spark plugs 51 and 52, etc. can be unloaded immediately by the diode 76, the positive polarity pulse 60 applied to the spark plugs 51 and 52 by way of the diodes 72 and 73 (or by way of the diodes 72 and 73, and the secondary winding 12) is not lowered. Due to this, even at the time of a misfire or at high engine speed, it becomes possible to apply the positive polarity pulse 60 of the voltage which is not so high as to cause spark discharge to the spark plugs 51 and 52.

(g) By setting the turn ratio of the coil 61 to 1:100 and by the use of the Zener diode 600 of a Zener voltage of 20 V, the positive polarity pulse 60 which is applied to the spark plugs 51 and 52 can be of such a voltage which is not so high as to cause spark discharge and which can set as high as possible (2 kV).

Figure 15:
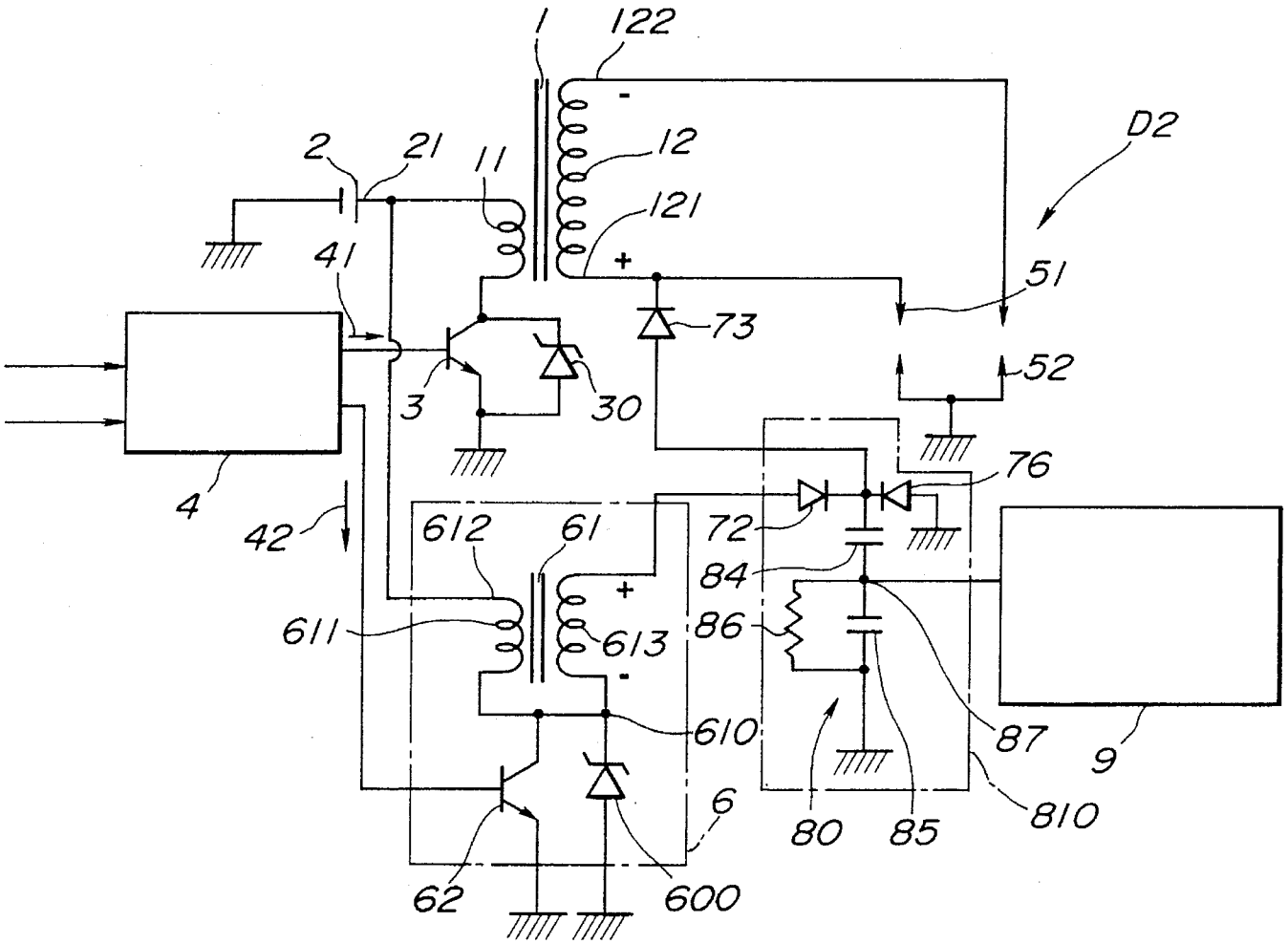
FIG. 15 is an electrical circuit diagram of a double-ended distributorless ignition system in which a misfire detecting device according to an eighth embodiment of the present invention is incorporated.

Then, referring to FIGS. 7 and 15, the eighth embodiment will be described.

A misfire detecting device of this embodiment incorporated in a double-ended distributorless ignition system "D2" from the seventh embodiment of FIG. 13 in that the voltage dividing circuit 80 and the diodes 72 and 76 are installed all together on a single substrate 810 and has, in addition to the above described advantages (b), (d), (f) and (g), the following advantage.

(h) The condensers which can be used as the capacitors 84 and 85 of the small and large capacities can be obtained with an increased freedom, and it becomes possible to make larger the input time constant which is determined by the capacitor 85 of a large capacity and the resistor 86 connected in parallel to the capacitor 85, by making larger the capacitors 84 and 85 whilst maintaining the capacity ratio constant. By this, the attenuation characteristic at the time of misfire is improved so that the difference of the waveforms at the time of misfire and at the time of firing can be made clearer.

Figure 16:
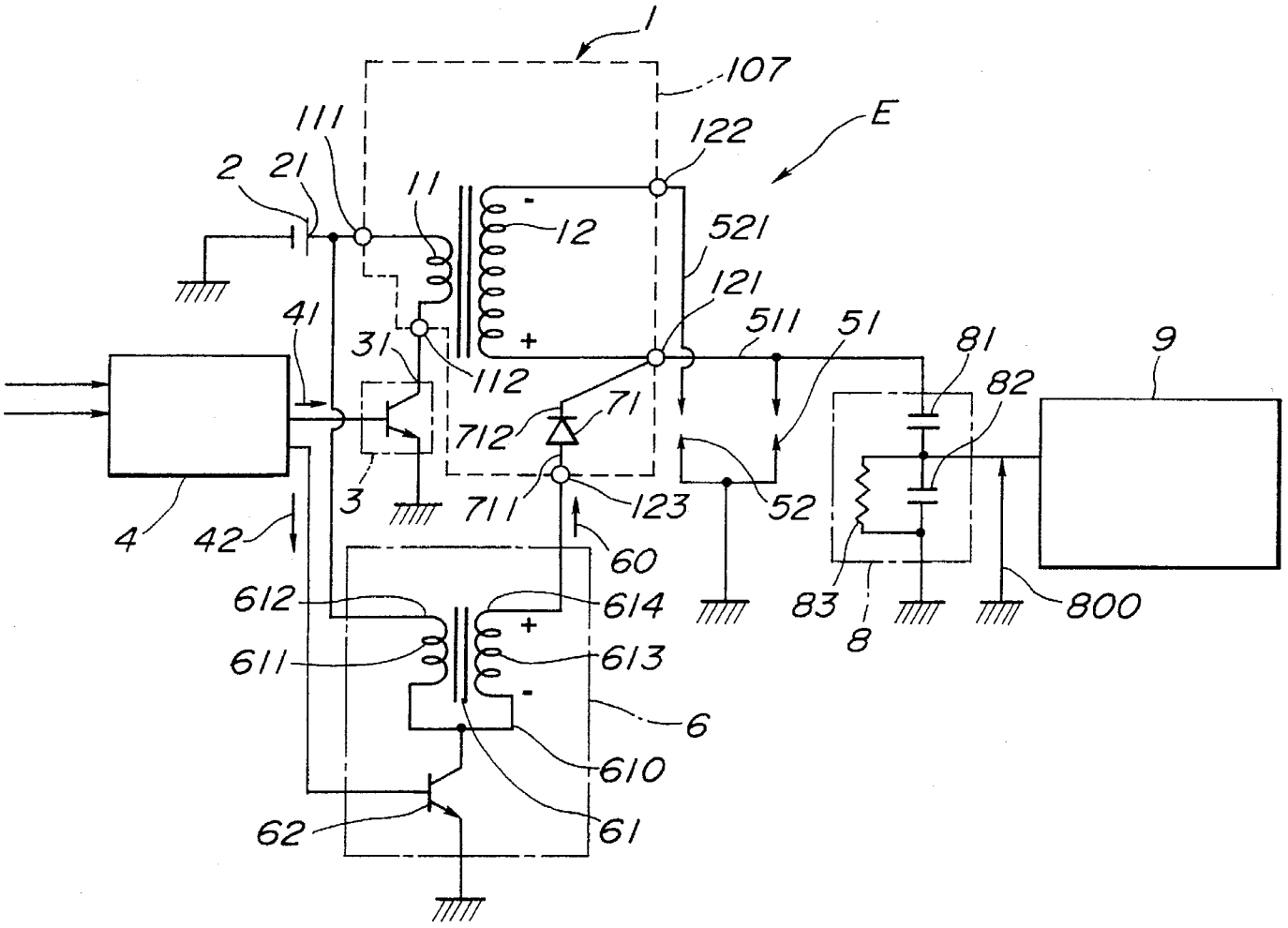
FIG. 16 is an electrical circuit diagram of a double-ended distributorless ignition system in which a misfire detecting device according to a ninth embodiment of the present invention is incorporated.
Figure 17:
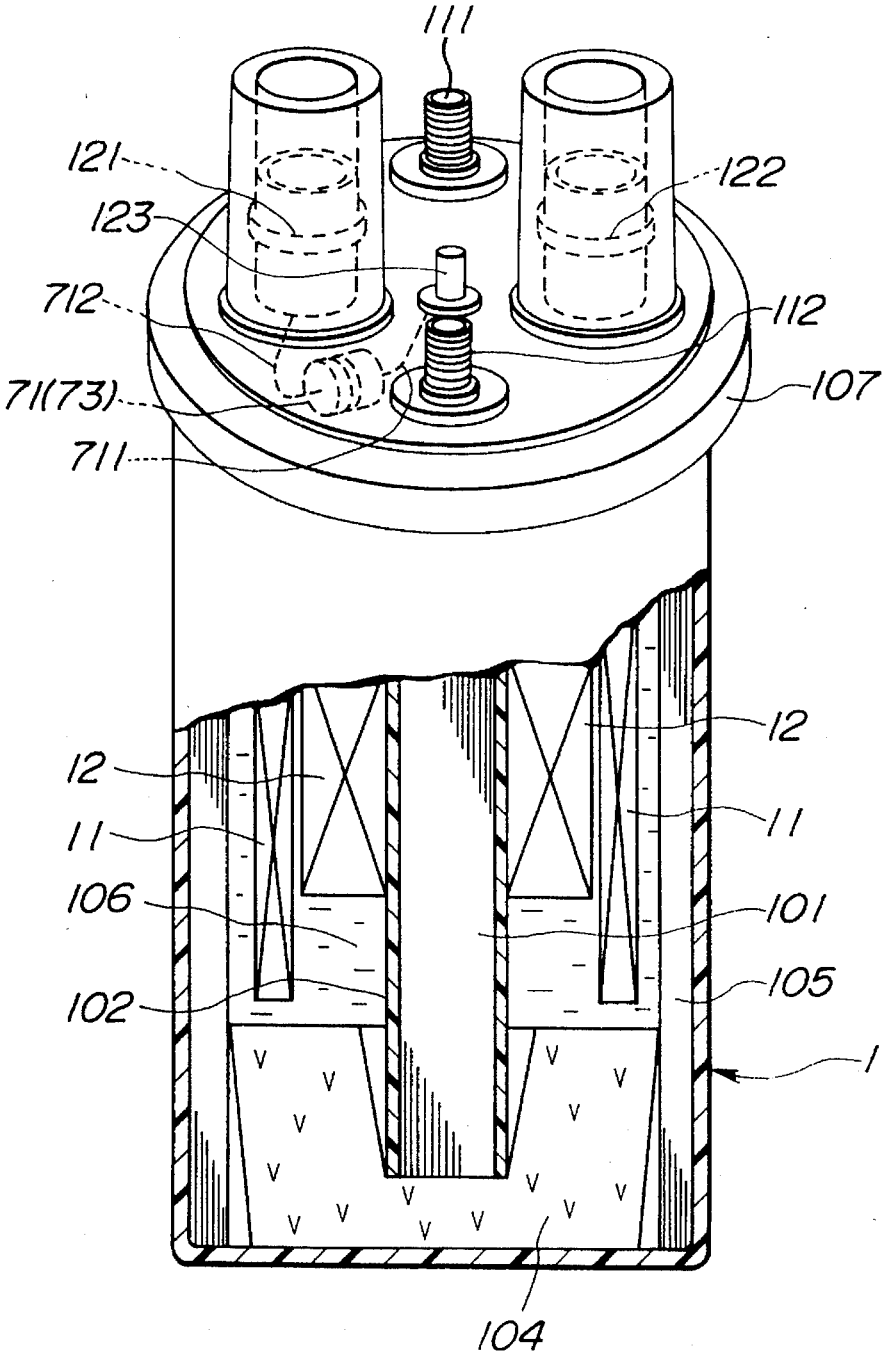
FIG. 17 is a view for illustration of the structure of an ignition coil for use in the double-ended distributorless ignition system of FIG. 16 or 18.

Referring to FIGS. 16 and 17, the ninth embodiment will be described.

A misfire detecting device of this embodiment incorporated in a double-ended distributorless ignition system "E" is substantially similar to the first embodiment of FIG. 1 except for the structure of the ignition coil 1 and the arrangement of the diode 71.

The ignition coil (for simultaneous firing) 1 is of the oil filled, open magnetic circuit iron core type and have the following structure. That is, hundreds of turns of a primary winding 11 are wound around a cylindrical member (not shown) of a large diameter. A coil main body is disposed within the cylindrical member and consists of tens of thousands of turns of a secondary winding 12 wound around a cylindrical bobbin 102 having a fixed center core 101 formed from laminated silicon steel plates. A side core 105 is disposed on the inner peripheral wall of the cylindrical member. The cylindrical body having disposed thereon and therein the primary winding 11, secondary winding 12, etc. is accommodated within a cylindrical casing 107 made of a resinous material filled with insulation oil and supported therein by means of insulator 104. Further, arranged on the upper end face of the casing 107 are primary terminals 111 and 112, a secondary high tension positive terminal 121, a secondary high tension negative terminal 122 and a terminal 123.

The ignition coil 1 is connected at the primary terminal 111 to the positive terminal 21 of the battery 2 and at the primary terminal 112 to the collector 31 of the power transistor 3. Further, the secondary high tension positive terminal 121 and the secondary high tension negative terminal 122 are connected to the center electrode sides of the spark plugs 51 and 52 by way of high tension cables 511 and 521, respectively.

The diode 71 disposed within the casing 107 is a high withstand voltage diode for allowing the positive polarity pulse 60 (about 3 kV) delivered from the pulse generating circuit 6 to be applied to the secondary high tension positive terminal 121 whilst preventing reverse current of a positive potential high voltage developed at the secondary high tension positive terminal 121, and is connected at the cathode 712 to the secondary high tension positive terminal 121 and at the anode 711 to the terminal 123.

Since the double-ended distributorless ignition system "E" having incorporated therein a misfire detecting device has the diodes 71 which is disposed within the casing 107 and is connected at the cathode 712 to the secondary high tension positive terminal 121 and at the anode 711 to the terminal 123, it can have, in addition to the above advantage (a), the following advantage.

(i) A difficult work otherwise necessitated in a prior art device, such as a work for connecting, after connecting an end of a high tension code to a secondary high tension positive terminal, the cathode line of a diode to the secondary high tension positive terminal or a halfway portion of a high tension cable, becomes unnecessary, so assembling of the misfire detecting device does not require much time and labor, thus making it possible to reduce the work cost.

(j) Since the diode 71 (in other embodiments, diodes 73 and 75) is not exposed to the outside, a good appearance can be attained. Further, even with vehicle vibrations or even if the ignition coil 1 or the high tension cables 511 and 521 are contacted by the hand of a worker during inspection of an engine, etc., the diode 71 is hardly acted upon by a force, so the cathode 712 is not disengaged from the secondary high tension positive terminal 121.

(k) One diode 71 will suffice that needs to be disposed within the casing 107 and thus can be disposed within the casing 107 with ease.

Figure 18:
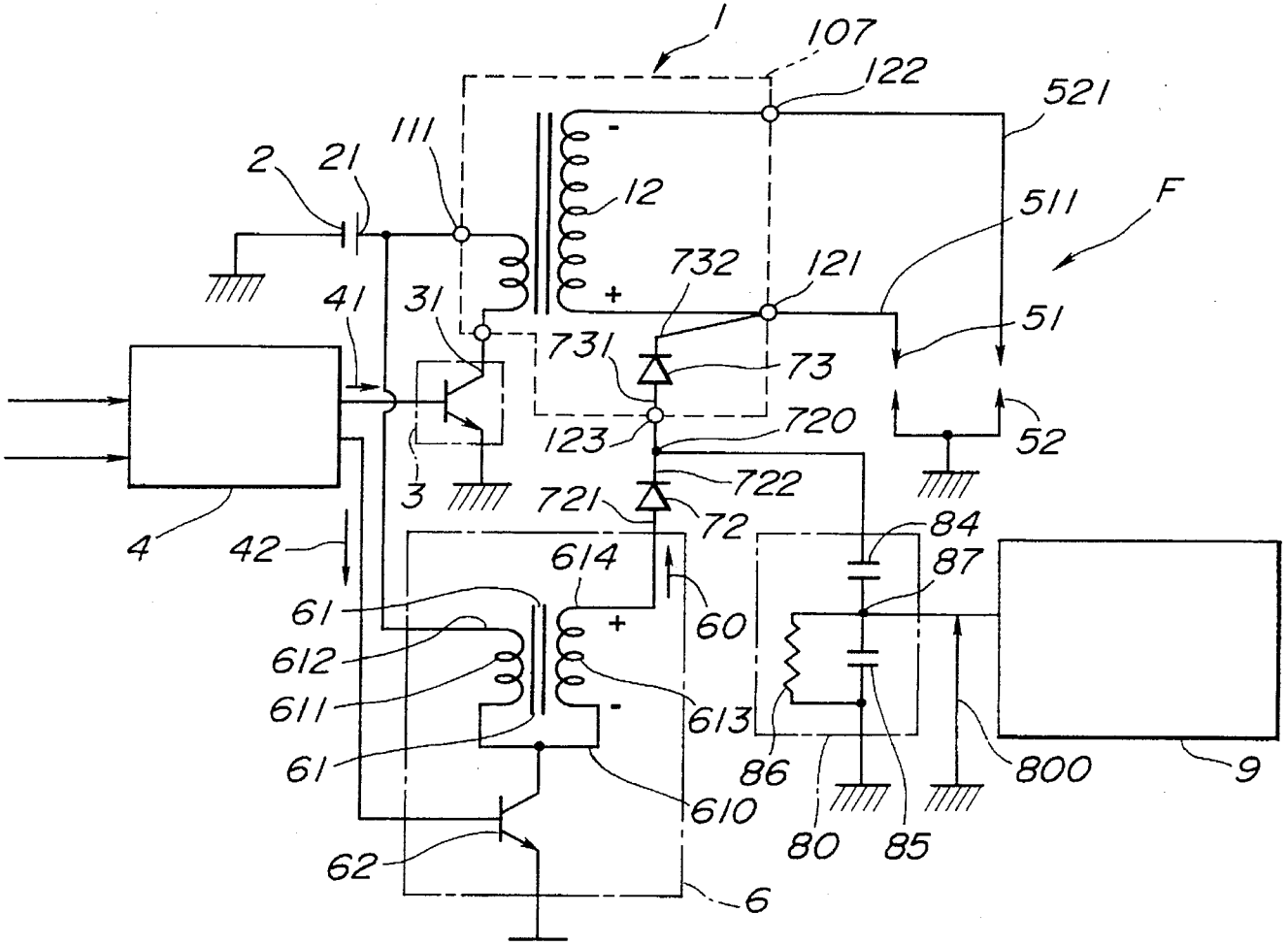
FIG. 18 is an electrical circuit diagram of a double-ended distributorless ignition system in which a misfire detecting device according to a tenth embodiment of the present invention is incorporated.

Referring to FIGS. 17 and 18, the tenth embodiment of the present invention will be described.

A misfire detecting device of this embodiment incorporated in a double-ended distributorless ignition system "F" is substantially similar to the second embodiment of FIG. 3 except for the structure of the ignition coil 1 and the arrangement of the diode 73.

The ignition coil 1 (refer to FIG. 17) has the same structure as that of the ninth embodiment of FIG. 17. The diode 73 (second diode) is a high withstand voltage diode disposed within the casing 107 similarly to the diode 71 of the ninth embodiment of FIG. 17 for preventing reverse current of a positive polarity high voltage developed at the secondary high tension positive terminal 121, and is connected at the cathode 732 to the secondary high tension positive terminal 121 and at the anode 731 to the terminal 123.

The diode 72 is disposed on the pulse generating circuit 6 side and is connected at the anode 721 to the secondary terminal 614 of the coil 61 and at the cathode 722 to the terminal 123 by way of a covered wire.

This embodiment has, in addition to the above described advantages (b), (i) and (j), the following advantage.

(1) Since the high voltage for spark discharge is checked by the diode 73, increase of the length of the covered wire between the terminal 123 and the diode 72 does not cause leakage of the high voltage for spark discharge, so the diode 72 needs not be disposed within the casing 107 but can be disposed on the pulse generating circuit 6 side. Accordingly, one diode will suffice that is disposed within the casing 107 (in other embodiments, the same number as that of the ignition coil or coils), and thus can be disposed within the casing 107 with ease.

Figure 19:
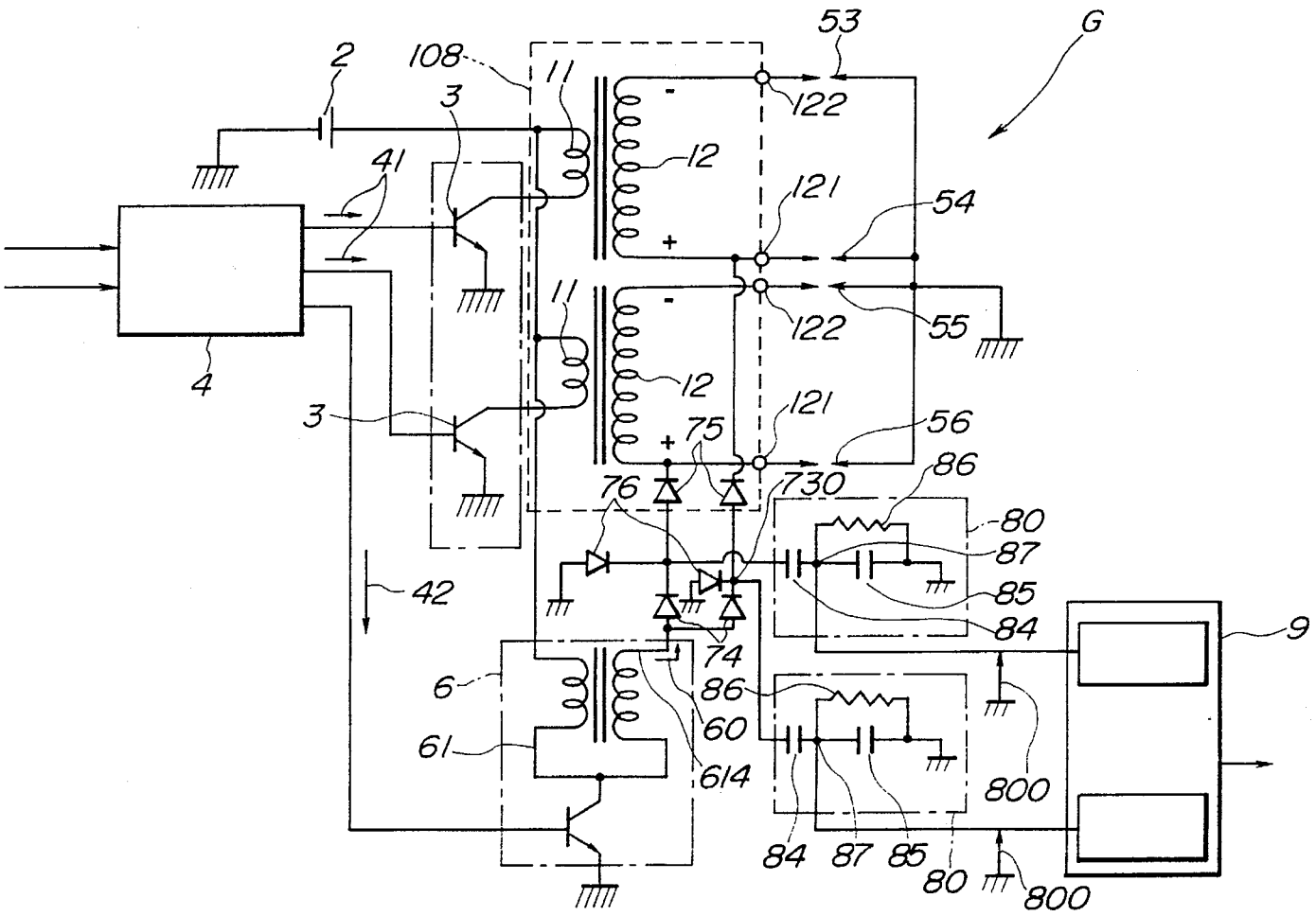
FIG. 19 is an electrical circuit diagram of a double-ended distributorless ignition system in which a misfire detecting device according to an eleventh embodiment of the present invention is incorporated.
Figure 20:
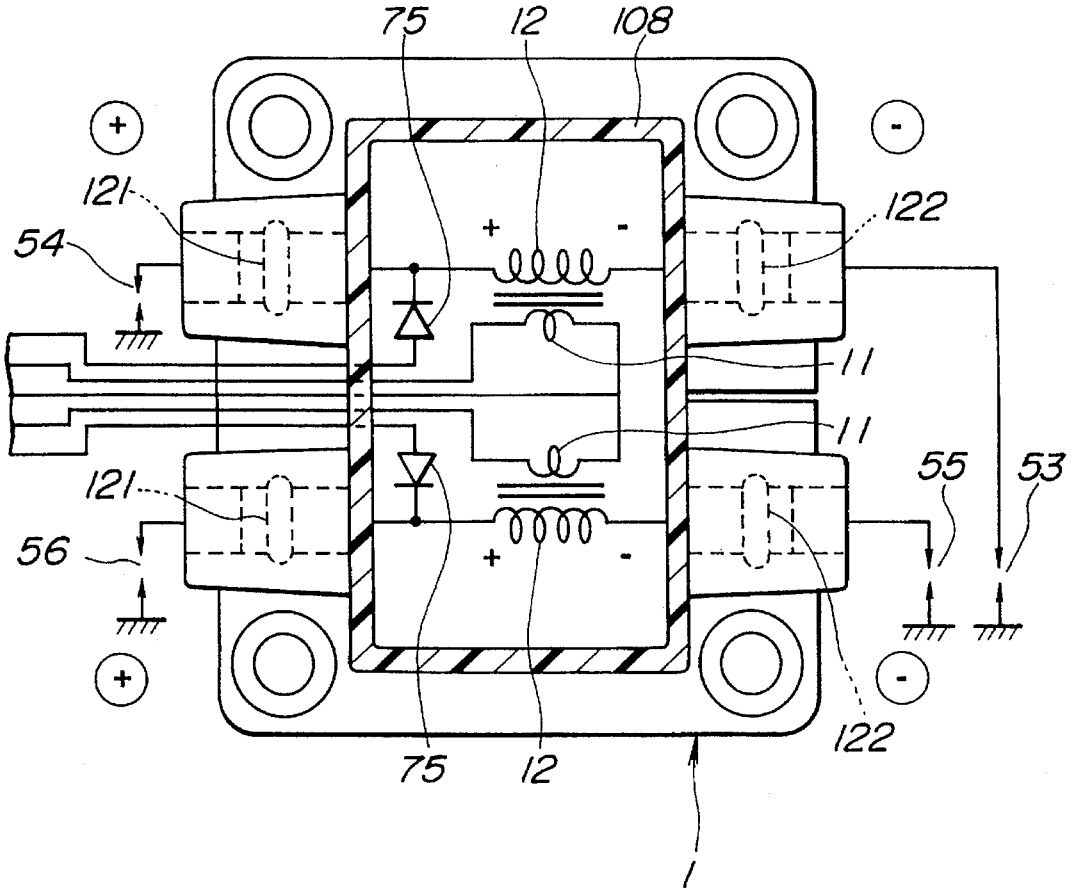
FIG. 20 is a view for illustration of the structure of an ignition coil for use in the double-ended distributorless ignition system of FIG. 19.
Figure 21:
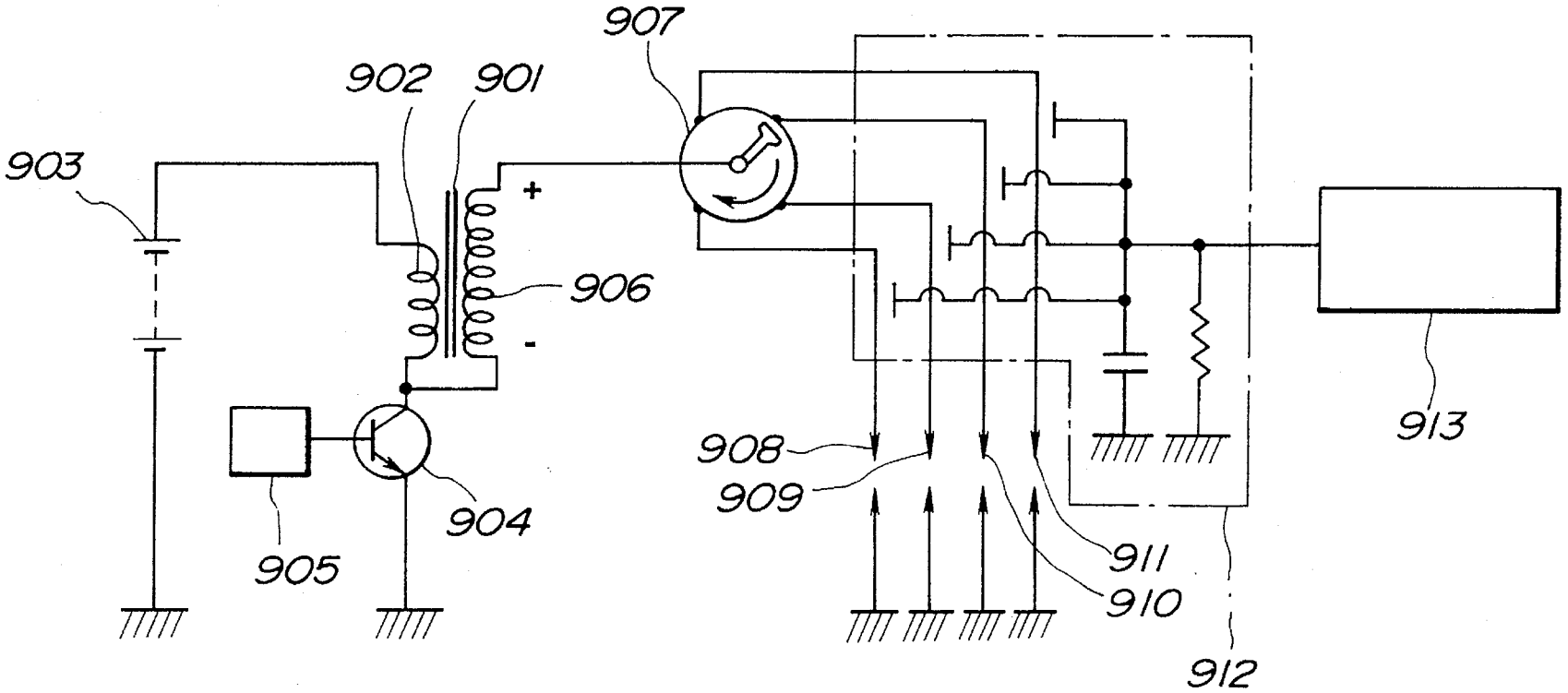
FIG.21 (PRIOR ART)
FIG. 21 is an electrical circuit diagram of a prior art ignition system.
Figure 22:
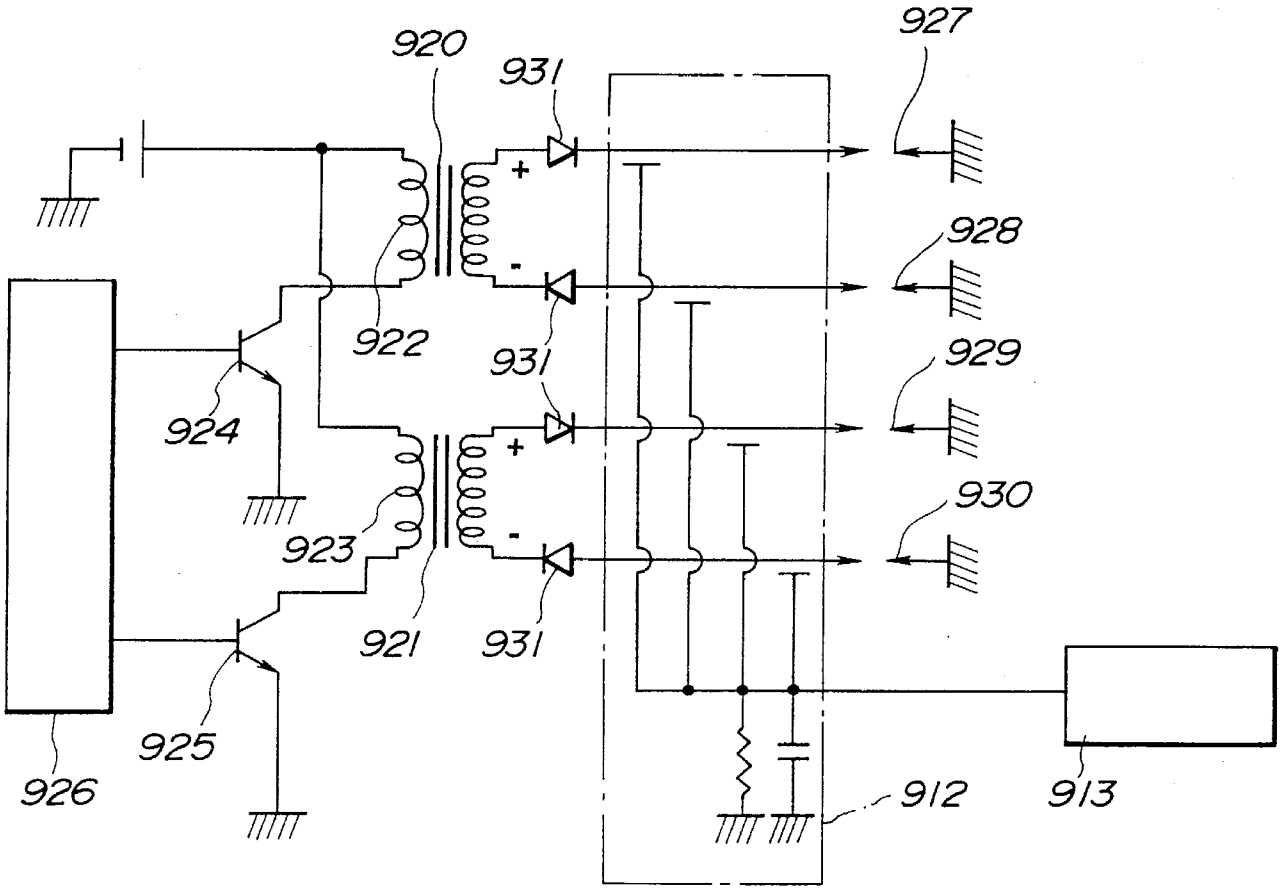
FIG.22 (PRIOR ART)
FIG. 22 is an electrical circuit diagram of another prior art ignition system.
Figure 23:
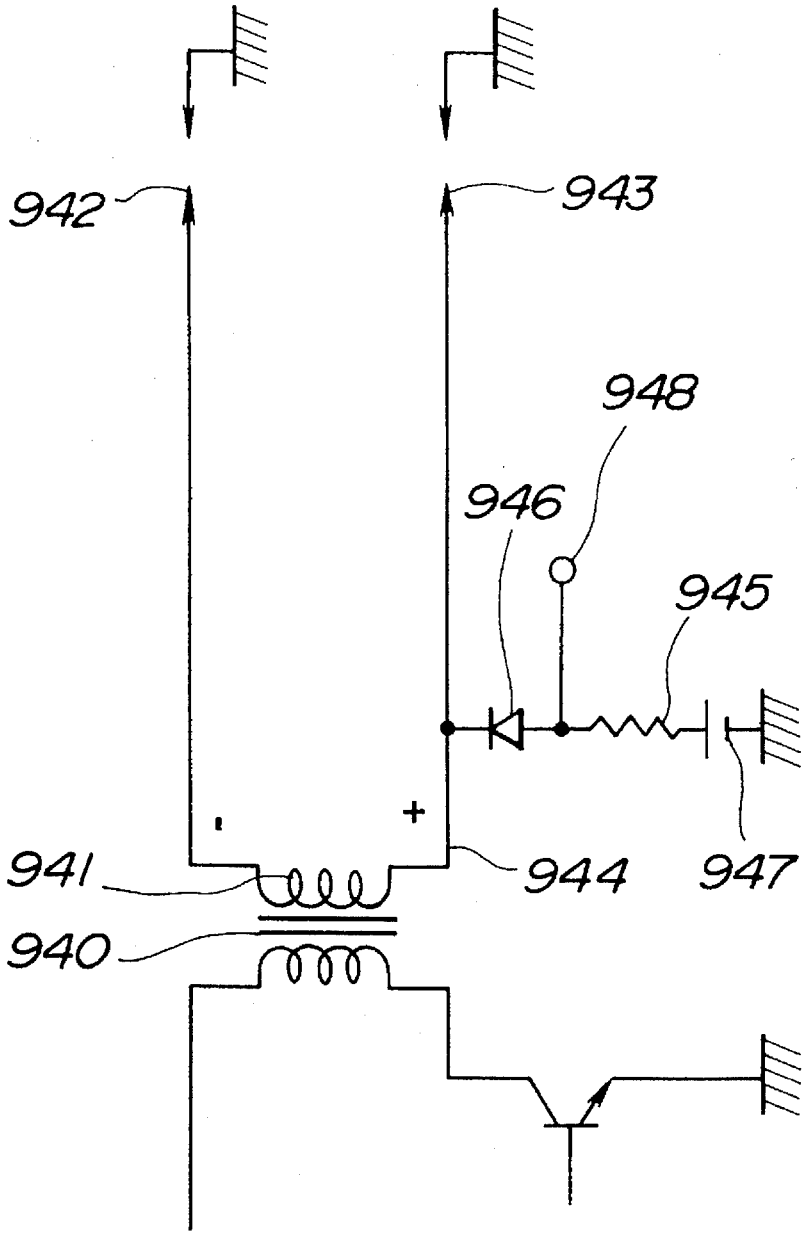
FIG.23 (PRIOR ART)
FIG. 23 is an electrical circuit diagram of a further prior art ignition system.

Referring to FIGS. 19 and 20, the eleventh embodiment of this invention will be described.

A misfire detecting device of this embodiment incorporated in a double-ended distributorless ignition system "G" is substantially similar to the fifth embodiment of FIG. 8 except for the structure of the ignition coil 1 and the arrangement of the diodes 75.

The ignition coil 1 (for simultaneous ignition or spark type) is, in this embodiment, of the oil filled, open magnetic circuit type and includes two coil main bodies of the same structure as that of the ninth or tenth embodiment which are accommodated within a cylindrical casing 108 made of a resinous material, having disposed on the inner peripheral wall thereof a side core (not shown) and filled with insulation oil (not shown) and supported therein by means of insulators (not shown) disposed at the opposite axial ends of the casing 108. Further, protruded from the opposite axial end faces of the casing 108 are tubular portions having disposed therewithin secondary high tension positive terminals 121 and secondary high tension negative terminals 122, respectively (refer to FIG. 20).

The primary winding 11 of the ignition coil 1 is connected by way of covered wires extending through the casing 108 and between the inside and outside of same, to the positive terminal of the battery 2 and the collector of the power transistor 3. Further, the anodes of the diodes 75 are connected by way of covered wires extending through the casing 108 and between the inside and outside of the same to the cathodes of the diodes 74, respectively. Further, the secondary high tension positive terminals 121 and the secondary high tension negative terminals 122 of the ignition coil 1 are fitted with high tension codes and connected to the center electrodes of the spark plugs 53~56, respectively (refer to FIG. 20).

The diodes 75 disposed within the casing 108 are high withstand voltage diodes for preventing reverse current of a positive potential high voltage developed at the secondary high tension positive terminal 121 and are electrically connected at the cathodes to the secondary high tension positive terminals 121, respectively.

The diodes 74 are disposed on the pulse generating circuit 6 side and are connected at the anodes to the secondary terminal 614 of the coil 61 and at the cathodes to the anodes of the diodes 75 within the casing 108 by way of covered wires.

The condenser voltage dividing circuits 80 are of the same structure as that of the second embodiment of FIG. 3 and each connected to each one of the coils.

This embodiment has advantages substantially the same as the above described advantages (b), (e), (i), (j) and (l).

While the present invention has been described and shown as above, the following variants are possible without departing from the scope of this invention.

(I) In case the withstand voltages of the diodes 71, 72, 73, 74, 75 and 76 are insufficient, a plurality of diodes may be connected in series to constitute the respective diodes.

(II) The delivering timing, continuation time and voltage of the positive polarity pulse 60 can be determined suitably so long as the delivering timing and continuation time are included within the period after completion of spark discharge and before beginning of application of a high voltage for spark discharge whilst the voltage is not so high as to cause spark discharge.

(III) In FIG. 13, the cathode 761 of the diode 76 can be connected to the anode 721 of the diode 72 without being connected to the cathode 722 of the diode 72.

(IV) In the ninth to eleventh embodiments, the condenser voltage dividing circuit 80 can be installed on a single substrate 810 as in the fourth embodiment of FIG. 7, together with the diodes 72, 74 and 76 if desirable.

From the foregoing, it will be understood that in the misfire detecting device according to an embodiment of the present invention a positive polarity pulse which is not causative of spark discharge between the center electrode and the outer electrode, is applied to a positive polarity side of a secondary winding by way of a reverse current preventing diode during the time after completion of spark discharge and before beginning of application of high voltage for next spark discharge, and a misfire detecting means detects the combustion condition at each cylinder, i.e., occurrence of a misfire of a spark plug at each cylinder on the basis of an attenuation characteristic of a divided voltage which is a fraction of a plug voltage, across a center electrode-to-outer electrode portion of a spark plug. Due to this, a positive potential is developed at the center electrode side, whereby it is made clearer or larger the difference of the attenuation characteristic of the plug voltage between the time of a misfire and the time of normal firing and therefore it becomes possible to detect the combustion condition of each cylinder, i.e., occurrence of misfire at each cylinder with accuracy without being affected by the conditions of the distribution lines. In this connection, a difficult waveform processing of a divided voltage is not necessitated.

It will be further understood that in the misfire detecting device according to another embodiment of the present invention a positive polarity pulse which is not causative of spark discharge between a center electrode and an outer electrode of a spark plug, is applied to a positive polarity side of a secondary winding by way of a first diode and a second diode during the time after completion of spark discharge and before beginning of application of high voltage for next spark discharge, and a misfire detecting means detects the combustion condition at each cylinder, i.e., occurrence of a misfire of a spark plug at each cylinder on the basis of an attenuation characteristic of a divided voltage which is a fraction of a total voltage, at a conjunction between the cathode of the first diode and the anode of the second diode. Due to this, a positive potential is developed at the center electrode side, whereby it is made clearer or larger the difference of the attenuation characteristic of the plug voltage between the time of a misfire and the time of normal firing and therefore it becomes possible to detect the combustion condition of each cylinder, i.e., occurrence of a misfire of a spark plug at each cylinder with accuracy without being affected by the conditions of the distribution lines. In this connection, a difficult waveform processing of a divided voltage is not necessitated. Further, the high voltage developed at the positive polarity side of the ignition coil for firing of a spark plug, is not input to the voltage dividing means by the reverse current preventing action of the second diode. Due to this, the misfire detecting device is not subjected to the influence of the high voltage for firing or ignition, thus making it possible to simplify the structure of the misfire detecting device.

It will be further understood that in the misfire detecting device according to a further embodiment of the present invention a positive polarity pulse which is not causative of spark discharge between a center electrode and an outer electrode of a spark plug, is applied to a positive polarity side of a secondary winding by way of a first diode and a second diode during the time after completion of spark discharge of a set of spark plugs connected to the same ignition coil during the time after completion of spark discharge of a set of spark plugs connected to the same ignition coil and before beginning of application of high voltage for spark discharge to another set of spark plugs, and a misfire detecting means detects the combustion condition at each cylinder, i.e., occurrence of a misfire of a spark plug at each cylinder on the basis of an attenuation characteristic of a divided voltage which is a fraction of a total voltage, at a conjunction between the cathode of the first diode and the anode of the second diode. Due to this, a positive potential is developed at the center electrode side, whereby it is made clearer or larger the difference of the attenuation characteristic of the plug voltage between the time of a misfire and the time of normal firing and therefore it becomes possible to detect the combustion condition of each cylinder, i.e., occurrence of misfire at each cylinder with accuracy without being affected by the conditions of the distribution lines. In this connection, a difficult waveform processing of a divided voltage is not necessitated. Further, the high voltage developed at the positive polarity side of the ignition coil for firing of a spark plug, is not input to the voltage dividing means by the reverse current preventing action of the second diode. Due to this, the misfire detecting device is not subjected to the influence of the high voltage for firing or ignition, thus making it possible to simplify the structure of the misfire detecting device. Further, detection of misfire can be attained with accuracy even at engine high speed.

What is claimed is:

1. A misfire detecting device for a double-ended distributorless ignition system having an ignition coil for simultaneous spark, primary current supplying means for supplying battery current to a primary winding of the ignition coil intermittently, a first spark plug connected at a center electrode side to a positive polarity side of a secondary winding of the ignition coil and grounded at an outer electrode side, and a second spark plug connected at a center electrode side to a negative polarity side of the secondary winding of the ignition coil and grounded at an outer electrode side, the misfire detecting device comprising:

pulse generating means for generating a positive polarity pulse which is not causative of spark discharge, during the time after completion of spark discharge and before beginning of application of an ignition high voltage for next spark discharge;

a reverse current preventing diode connected at an anode to an output end of said pulse generating means and at a cathode to the positive polarity side of the secondary winding of the ignition coil;

plug voltage dividing means for dividing a plug voltage across a center electrode-to-outer electrode of each of the spark plugs to obtain a divided voltage thereat; and detecting means for detecting a misfire of the spark plugs on the basis of an attenuation characteristic of said divided voltage after application of said positive polarity pulse.

2. A misfire detecting device according to claim 1, further comprising a diode connected at a cathode to an anode side of said reverse current preventing diode and grounded at an anode for unloading a negative charge remaining in a floating capacity of the spark plugs.

3. A misfire detecting device according to claim 1, wherein said voltage dividing means comprises a condenser voltage dividing circuit constructed of a capacitor of a small capacity and a capacitor of a relatively large capacity which are connected in series.

4. A misfire detecting device according to claim 1, wherein said diode is disposed within an electrically insulated casing of said ignition coil.

5. A misfire detecting device for a double-ended distributorless ignition system having an ignition coil for simultaneous spark, primary current supplying means for supplying battery current to a primary winding of the ignition coil intermittently, a first spark plug connected at a center electrode side to a positive polarity side of a secondary winding of the ignition coil and grounded at an outer electrode side, and a second spark plug connected at a center electrode side to a negative polarity side of the secondary winding of the ignition coil and grounded at an outer electrode side, the misfire detecting device comprising:

pulse generating means for generating a positive polarity pulse which is not causative of spark discharge, during the time after completion of spark discharge and before beginning of application of an ignition high voltage for next spark discharge;

first and second reverse current preventing diodes connected in series to each other for allowing said positive polarity pulse to pass therethrough and be supplied to the positive polarity side of the secondary winding of the ignition coil;

voltage dividing means for dividing a voltage at a junction between an anode of said first diode and a cathode of said second diode to obtain a divided voltage thereat; and detecting means for detecting a misfire of the spark plugs on the basis of an attenuation characteristic of said divided voltage.

6. A misfire detecting device according to claim 5, further comprising a diode connected at a cathode thereof to an anode side of one of said first and second diodes and grounded at an anode thereof for unloading a negative charge remaining in a floating capacity of the spark plugs.

7. A misfire detecting device according to claim 5, wherein said voltage dividing means comprises a condenser voltage dividing circuit constructed of a capacitor of a small capacity and a capacitor of a relatively large capacity which are connected in series.

8. A misfire detecting device according to claim 5, wherein said voltage dividing means comprises a condenser voltage dividing circuit constructed of a capacitor of a small capacity electrically connected at one of opposite ends to said junction and a capacitor of a relatively large capacity connected at one of opposite ends to the other of said opposite ends of said capacitor of a small capacity and grounded at the other of said opposite ends thereof, said capacitors being installed on a single insulation substrate.

9. A misfire detecting device according to claim 5, wherein said second diode is disposed within an electrically insulated casing of said ignition coil.

10. A misfire detecting device for a double-ended distributorless ignition system having a plurality of ignition coils for simultaneous spark, primary current supplying means for supplying battery current to primary windings of the ignition coils intermittently and in turn, and a plurality of spark plugs connected at center electrode sides to secondary windings of the ignition coils and grounded at outer electrode sides, the misfire detecting device comprising:

pulse generating means for generating a positive polarity pulse which is not causative of spark discharge, during the time after completion of spark discharge of one of the spark plugs and before beginning of spark discharge of another of said spark plugs which is to discharge next;

first diodes of the same number as the ignition coils and each connected at an anode to an output end of said pulse generating means;

second diodes of the same number as the ignition coils and each connected at an cathode to a positive polarity side of the secondary winding of each of the ignition coils and at an anode to a cathode of each of said first diodes;

voltage dividing means for dividing voltages at junctions between said cathodes of said first diodes and said anodes of said second diodes to obtain divided voltages thereat; and detecting means for detecting a misfire of the spark plugs on the basis of attenuation characteristics of said divided voltages.

11. A misfire detecting device according to claim 10, further comprising a diode connected at a cathode thereof to an anode side of one of said first and second diodes and grounded at an anode thereof for unloading a negative charge remaining in a floating capacity of the spark plugs.

12. A misfire detecting device according to claim 10, wherein said voltage dividing means comprises a condenser voltage dividing circuit constructed of a capacitor of a small capacity and a capacitor of a relatively large capacity which are connected in series.

13. A misfire detecting device according to claim 10, wherein said voltage dividing means comprises a condenser voltage dividing circuit constructed of a capacitor of a small capacity electrically connected at one of opposite ends to said junction and a capacitor of a relatively large capacity connected at one of opposite ends to the other of said opposite ends of said capacitor of a small capacity and grounded at the other of said opposite ends thereof, said capacitors being installed on a single insulation substrate.

14. A misfire detecting device according to claim 10, wherein said second diode is disposed within an electrically insulated casing of said ignition coil.

* * * * *